US012428218B2

(12) United States Patent
Oh et al.

(10) Patent No.: US 12,428,218 B2
(45) Date of Patent: Sep. 30, 2025

(54) ENERGY DIRECTOR RELEASABLY SEALING SINGLE-SERVE BEVERAGE POD

(71) Applicants: Sung Oh, West Covina, CA (US); Zhiyu Zhang, Heyuan (CN)

(72) Inventors: Sung Oh, West Covina, CA (US); Zhiyu Zhang, Heyuan (CN)

( * ) Notice: Subject to any disclaimer, the term of this patent is extended or adjusted under 35 U.S.C. 154(b) by 990 days.

(21) Appl. No.: 17/229,792

(22) Filed: Apr. 13, 2021

(65) Prior Publication Data

US 2021/0354908 A1 Nov. 18, 2021

Related U.S. Application Data

(60) Provisional application No. 63/009,454, filed on Apr. 13, 2020.

(51) Int. Cl.
*B65D 85/804* (2006.01)

(52) U.S. Cl.
CPC ..... *B65D 85/8061* (2020.05); *B65D 85/8064* (2020.05)

(58) Field of Classification Search
CPC ..... B65D 85/8061; B65D 85/8064
See application file for complete search history.

(56) References Cited

U.S. PATENT DOCUMENTS

2012/0058226 A1* 3/2012 Winkler ..... A47J 31/3695 426/431
2021/0078794 A1* 3/2021 Giuliano ..... B65D 85/8061

OTHER PUBLICATIONS

Branson, "Design Guide for Ultrasonic Welding", Emerson Industrial Automation, Sep. 19, 2017, http://www.hankyan.com/design%20guide%20for%20ultrasonic%20welding%20Branson.pdf. (Year: 2017).*

* cited by examiner

*Primary Examiner* — Christopher W Raimund
(74) *Attorney, Agent, or Firm* — Scott R. Hansen; Viking IP Law

(57) ABSTRACT

A beverage pod is assembled to allow the upper extension of the filter to separate from the upper rim of the container upon an application of force upon the extension. An energy director may be provided between the extension and the rim such that when a linear vertical high-frequency energy is applied to the energy director, the energy director may melt and releasably join the extension to the rim. At least one of the extension and/or the rim may have an energy director protruding therefrom. Separating the extension from the rim may form a gap between the extension and the rim to allow the beverage formed within the pod to drain therethrough.

11 Claims, 27 Drawing Sheets

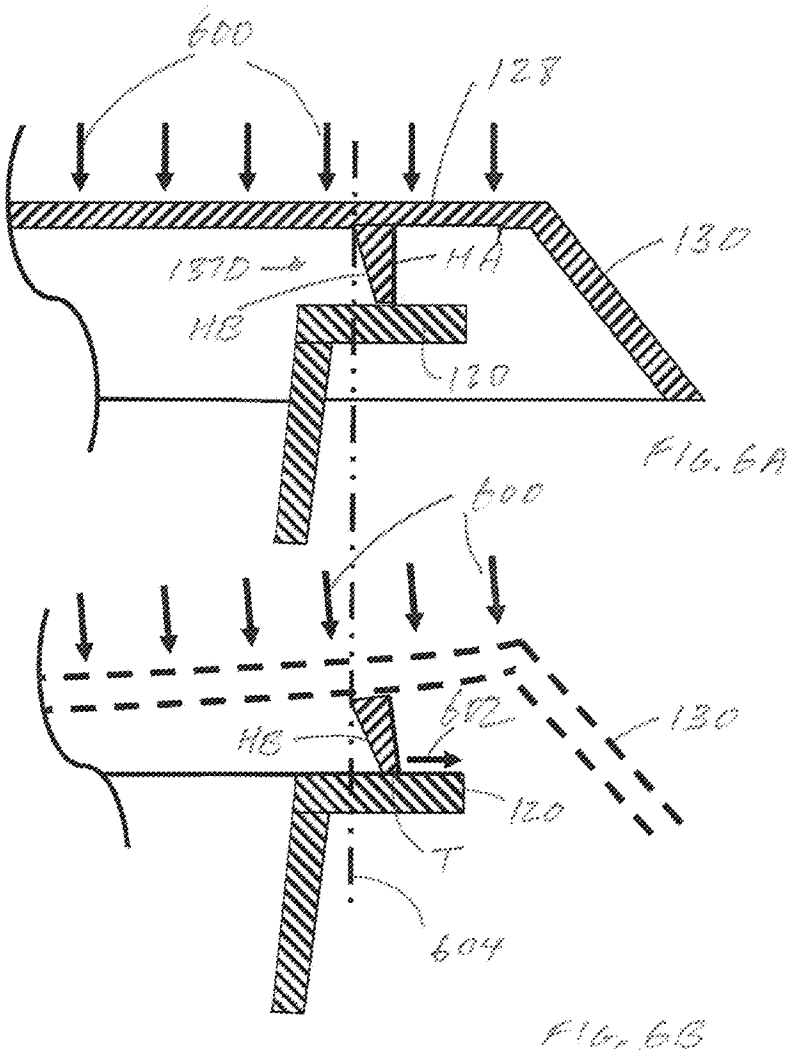
FIG. 6A
FIG. 6B
600
604
602
120
130
128
116
130D
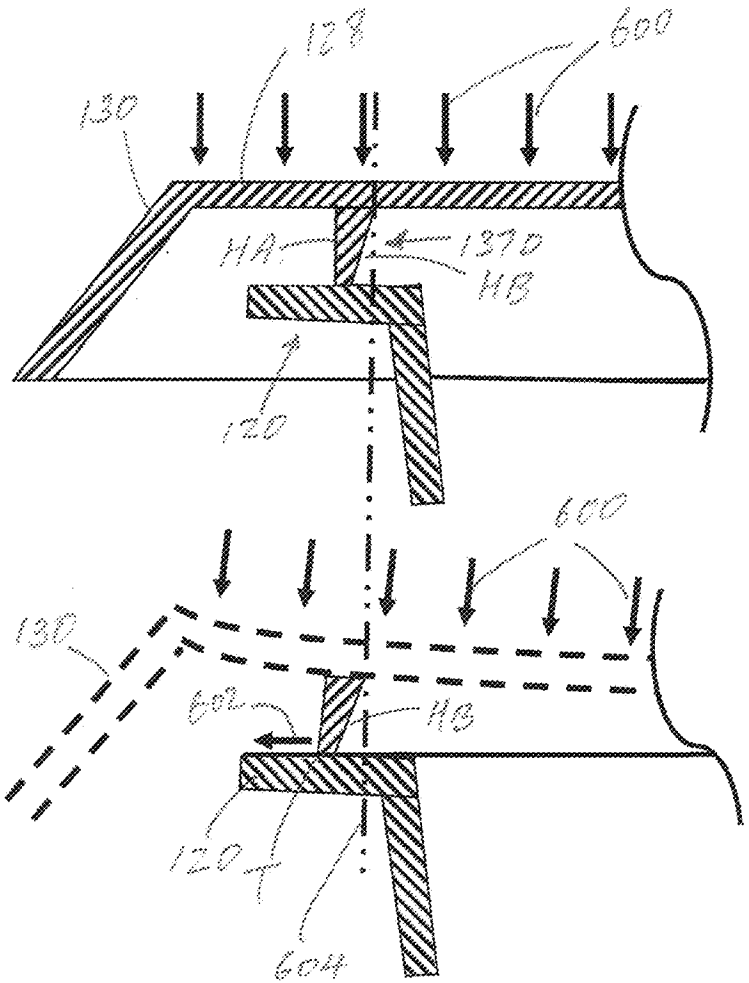
600
604
602
120
130
128
116
130D

ENERGY DIRECTOR RELEASABLY SEALING SINGLE-SERVE BEVERAGE POD

RELATED APPLICATION

This application claims priority to a U.S. Provisional Patent Application Ser. No. 63/009,454, filed Apr. 13, 2020, entitled "System of Assembling a Single-Serving Beverage Pod", which is hereby incorporated by reference in its entirety.

BACKGROUND OF THE INVENTION

Field of the Invention

A single-serve pod may be adapted to releasably seal the upper portion of a filter to a rim of the container to hermetically seal the beverage ingredient therein and to separate the upper portion of the filter from the rim to drain the extract beverage from the pod; and in particular, to seal the upper portion to the rim in a substantially consistent manner to allow the upper portion to separate around the circumference of the rim in a substantially similar manner.

Background of the Invention

The following background discussion is not an admission that the matters discussed below are citable as prior art or common general knowledge. Rather, the general background information disclosed herein is directed at describing the problem(s) associated with the current state of the art, and a need for a better solution.

Single-serve pod systems for brewing beverages such as coffee and espresso are popular for their convenience and variety of different flavored beverages offered. One of the problems with such a brewing system is that an outlet needle is generally needed to pierce through the pod to drain the beverage from the pod, which can get clogged and contaminate the beverage. For example, the coffee beverage packed in coffee pods is organic, which means that over time bacteria and mold can grow inside the outlet needle and along the path the coffee beverage flows within the brewer before pouring into the mug, unless the brewer is rinsed regularly, which is not done by many users. In most instances, coffee is brewed at about 190° F. (88° C.), which is hot enough to kill most bacteria and mold, however, as the beverage drains from the brewer the bacteria and mold wash away with the beverage, which can hinder the taste of the coffee. Accordingly, there is a need for a single-serve pod that can drain the beverage without the need of an outlet needle.

INVENTION SUMMARY

One of the aspects of the invention is provide a filter for a single-serve pod comprising: a filter having a base that tappers upwardly to form a sidewall and extending outwardly to form an extension having an underside to be placed over an outer container, the extension having an energy director protruding downwardly from the underside to be placed over a rim of the container, the energy director having a non-isometric shape with an inner side and an outer side converging towards a tip side where the inner side is tapered relative to the underside to form an obtuse angle therebetween, and the outer side is substantially perpendicular relative to the underside.

Another aspect of the invention is to provide a method of assembling a beverage pod having a filter having an extension, and a container having a rim, the method comprising: positioning the extension of the filter juxtaposed to the rim of the container; and applying a predetermined amount of vertical ultrasonic energy on a non-isometric shape energy director between the extension and the rim where a center of gravity of the energy director is offset relative to a midpoint of a distal tip side such that the vertical ultrasonic energy causes the distal tip side to slide outwardly, and the predetermined amount of vertical ultrasonic energy releasably joins the energy director to the rim around a circumference of the extension such that an application of a predetermined force upon the on the extension causes the extension to separate from the rim.

Still another aspects of the invention is to provide a method of assembling a beverage pod with a filter having an extension, a container having a rim, and the method comprising: positioning the extension of the filter juxtaposed to the rim of the container; and melting an energy director between the extension and the rim to releasably join the extension to the rim around a circumference of the extension such that an application of a force on the extension causes the extension to separate from the rim.

Yet another aspect of the invention is to provide a method of assembling a beverage pod with a filter having an extension, a container having a rim, and the method comprising: sealing the beverage ingredient within a filter; positioning the filter with the extension facing down; positioning the rim of the container juxtaposed to the extension of the filter; and melting an energy director between the extension and the rim to releasably join the extension to the rim. The method may also include the step of sealing does not damage the energy director between the extension and the rim. The method may further include positioning the filter in an upright position with an extension defining an opening adapted to receive the beverage ingredient. The method may further include positioning a distributor juxtaposed to the beverage ingredient.

BRIEF DESCRIPTION OF THE DRAWINGS

The invention can be better understood with reference to the following drawings and description. The components in the figures are not necessarily to scale, emphasis is instead placed upon illustrating the principles of the invention. Moreover, in the figures, the referenced numerals designate the corresponding parts throughout the different views.

FIG. 4E shows a lid placed over the extension of the filter.

FIG. 6A shows a cross-sectional view of filter and container with the energy director of FIG. 5C between the extension and the rim.

FIG. 6B shows a cross-sectional view of filter and container with the non-isometric energy director sliding laterally towards the second extension due to the vertical force upon the extension.

DETAILED DESCRIPTION OF THE INVENTION

Figure 1B:
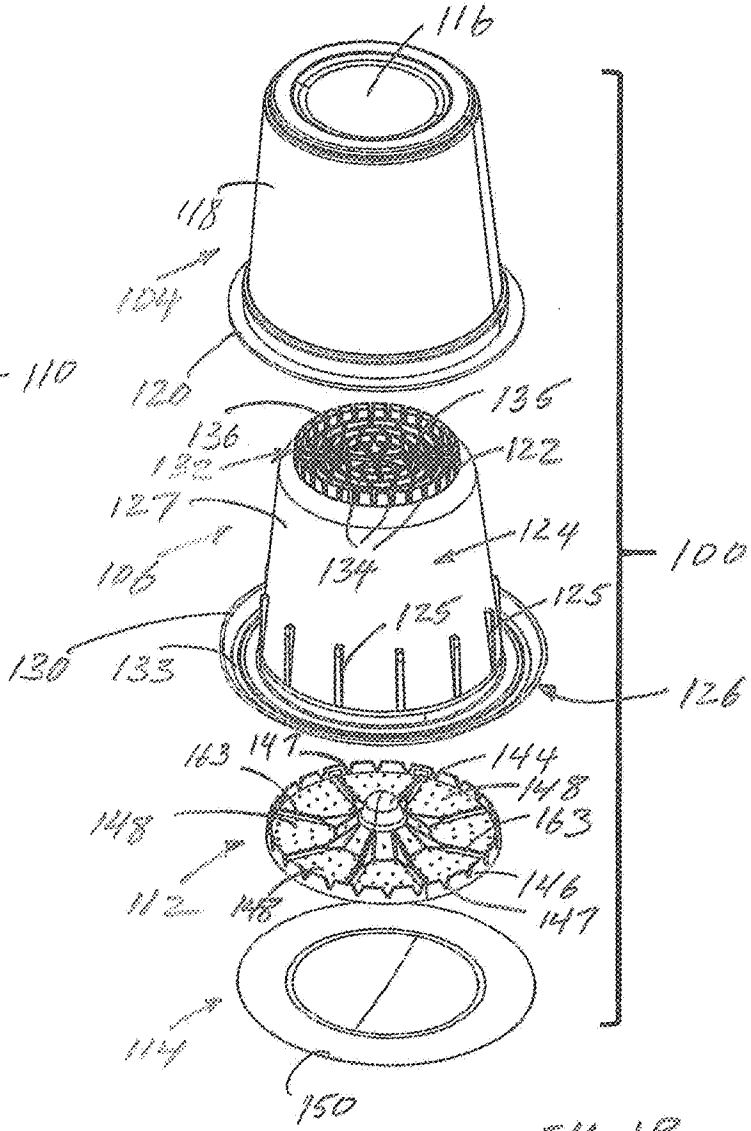
FIG. 1B shows an inverted expanded perspective view of the pod of FIG. 1A.

The various aspects of the invention can be better understood with reference to the drawings and descriptions described below. The components in the figures, however, are not necessarily to scale, and emphasis is instead placed upon illustrating the principles of the various aspects of the invention. The claimed invention is not limited to apparatuses or methods having all of the features of any one apparatus or method described below or to features common to multiple or all of the apparatuses described below. The claimed invention may reside in a combination or subcombination of the apparatus' elements or method steps described below. It is possible that an apparatus or method described below is not an example of the claimed invention. In general, when the terms "may", "is", and "are" are used as a verb in the description corresponding to a particular subject matter, these terms are generally used in this disclosure as an expression of a possibility of such subject matter rather than as a limiting sense such as when the terms "shall" and "must" are used. For example, when the description states that the subject matter "may be" or "is" circular, this is one of many possibilities, such that the subject matter can also include an oval, square, regular, irregular, and any other shapes known to a person ordinarily skilled in the art rather than being limited to the "circular" shape as described and/or illustrated in the corresponding referenced figure(s). In addition, when the term "may", "is", and "are" are used to describe a relationship and/or an action, these terms are generally used in this disclosure as an expression of a possibility. For example, when the description states that a subject matter A "may be" or "is" adjacent to a subject matter B, this can be one of many possibilities including the possibility that the subject matter A is not adjacent to the subject matter B or that the subject matter A may be connected, coupled, or engaged with the subject matter B as it would be understood by a person ordinarily skilled in the art.

Moreover, it is within the scope of the invention to combine the various embodiments disclosed relating to one or more particular drawings and their corresponding descriptions with one or more of the other drawings and their corresponding descriptions disclosed herein and/or other references incorporated herein by reference where such a combination may be combined and practiced by one ordinarily skilled in the art. The phrase "single-serve beverage pod" or "beverage pod" or the like in this disclosure generally refers to a single brewing process where a desired volume of beverage is brewed to serve one cup of beverage, however, it is within the scope of the invention to have a pod that packs sufficient beverage substance to brew multiple cups of beverage from a single brewing process or from multiple brewing processes. Also, the term "beverage substance" or "beverage ingredient" or the like generally refers to the underlying article when mixed with liquid such as water formulates a beverage such as coffee, tea, fruit drinks, punch, lemonade, soda, cocoa, milk, soup, energy drink, liquid medicine, cannabis, and the like. For instance, for coffee, the beverage substance may be coffee ground, instant powder coffee, and/or concentrated coffee in liquid form that can be diluted with water for consumption. For tea, the beverage substance may be tea ground, instant powder tea, and/or concentrated tea in liquid form that can be diluted with water for consumption. For baby milk, the beverage substance may be milk powder or concentrated milk liquid. For medicine such as for the flu or cold, the beverage substance may be in the powder or liquid form which can be dissolved with a predetermined portion of the heated water to brew a proper portion of the liquid medicine. Cannabis may be also provided in dried ground or powder form. In addition, the beverage substance may be provided in the form of pellets that are infused with desired flavors; and once the pellets are exposed to liquid such as water, the trapped flavors may be released by the pellets, which are then absorbed by the mixing liquid to formulate a beverage with the desired flavor. As such, the beverage substance may be in the form of ground, powder, liquid, pellets, and the like; and the beverage substance may be formulated from single or multiple ingredients. The same referenced numerals referred to in the drawings and descriptions generally correspond to the same or similar parts throughout the disclosure.

Figure 1A:
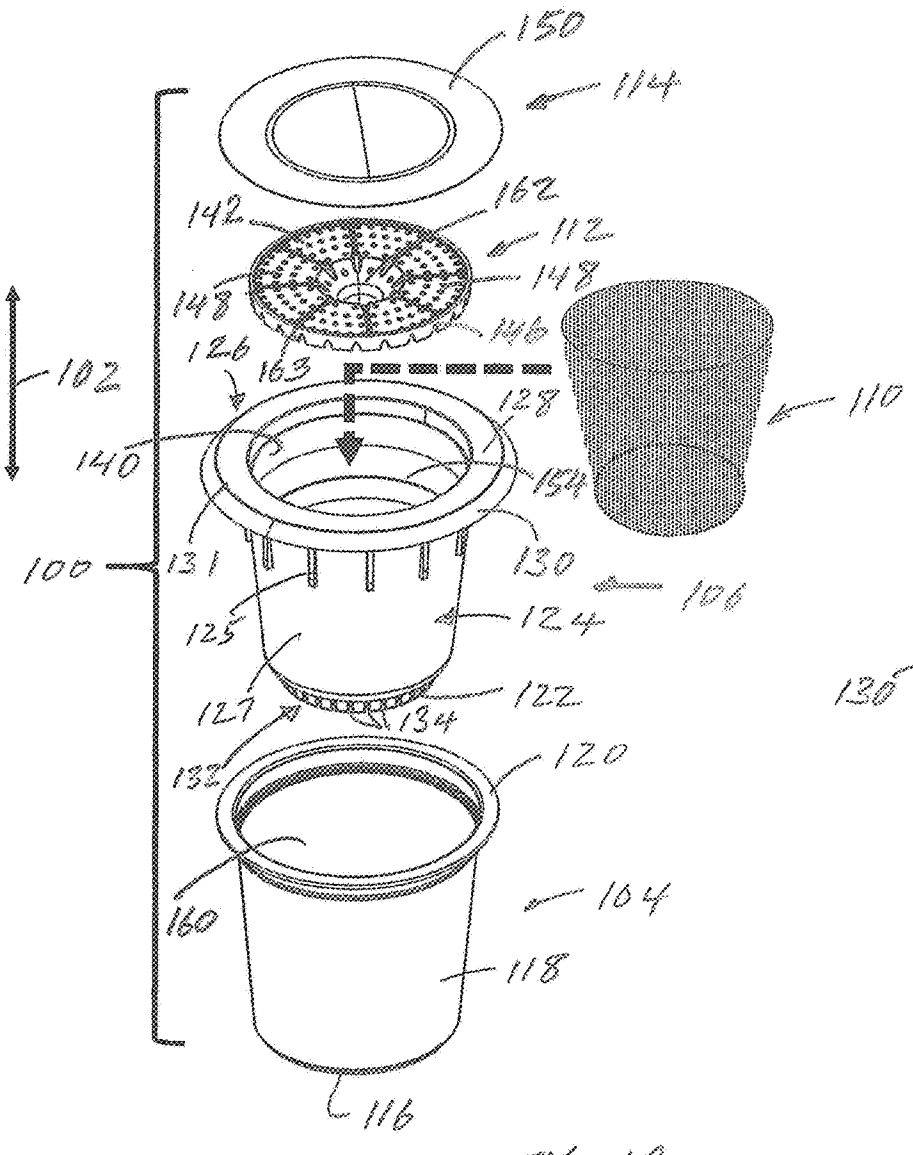
FIG. 1A shows an upright expanded perspective view of a pod along a longitudinal axis.

FIG. 1A shows an upright expanded perspective view of a pod 100 along a longitudinal axis 102 configured to brew beverages such as coffee and espresso; and FIG. 1B shows an inverted expanded perspective view of the pod 100 along the axis 102 to show the top and bottom views, respectively, of the various components of the pod 100. The pod 100 may include a container 104, a filter 106 adapted to receive beverage ingredient 110, a distributor 112, and a lid 114. The container 104 may have a base 116 that extends upwardly to form a sidewall 118 and then extends outwardly to form a rim 120 defining an opening 160. The container 104 may be formed from a variety of materials and from single or multilayered sheets sandwiched together to form a hermetically sealed barrier to protect the beverage ingredients contained therein from atmospheric oxygen entering the container. The container may be formed from a variety of materials known to one skilled in the art. In this regard, the container 104 may be formed in a manner described in U.S. Pat. No. 10,336,498 issued Jul. 2, 2019, entitled "CONTAINER WITH IMPROVED PUNCTUREABILITY", by Foster et al., which is hereby incorporated by reference in its entirety. In particular, the container 104 may be formed by a molding and thermoforming process of thermoplastic material, which may be substantially impermeable and imperforate. For example, the thermoplastic materials may include polyolefins such as polypropylene and polyethylene, polystyrene, nylon, and other polymers; and in particular, thermoplastic material may be a bio-based resin, readily recyclable, and/or comprise of at least a portion of recycled material such as a recycled polypropylene base resin.

The filter 106 may have a base 122 that extends upwardly to form a sidewall 124 and then extends outwardly to form an extension 126, which may be defined by one or more sections including a first section 128 and a second section 130. The first extension 128 may define an opening 154 adapted to receive the beverage ingredient 110. The first section may extend outwardly to a predetermined distance indicated by a reference numeral 131, and the second section 130 may extend farther therefrom outwardly in a beveled manner or downward sloping manner relative to the first section 128 towards the base 122. The extension 126 may have a line of weakness 133 between the first and second extensions 128 and 130 to allow the second extension 130 to weaken or separate from the first section 128 along the line of weakness 133, if desired. As discussed in more detail below, the line of weakness may allow the first section 128 to separate more readily from the rim 120 of the container. The first section 128 may extend outwardly at a distance, as indicated by the reference numeral 131, such that the first section 128 may extend farther out laterally than the rim 120 to allow the first section 128 to lay upon or overlap the rim 120 when the filter 106 is placed within the container 104. The base 122 of the filter 106 may have a plurality of holes 136 where the size and number of the holes 136 may be predetermined to control the flow of the beverage through the holes 136 to provide a desired pressure within the filter 106, as discussed in more detail below. The base 122 may also have at least one retainer wall 132 with a plurality of slits 134, as discussed in more detail below.

The container 104 may be adapted to receive the filter 106 and the first section 128 of the extension 126 may be releasably sealed or adhered to the rim 120 of the container 104 where upon a force applied to the underside of the second section 130, the first section 128 may peel, separate, and/or snap off from the rim 120. In this regard, the releasable bond(s) may be utilized such as the embodiments disclosed in US Published Application No. 2014/0161936, published Jun. 12, 2014, entitled CONTAINER WITH REMOVALE PORTION by Trombetta et al., which is hereby incorporated by reference in its entirety. Alternatively, the first section 128 of the filter 104 may be ultrasonically sealed to the rim 120 of the container 104 such as with the torsional ultrasonic welding method where high-frequency vibrational energy may be applied tangentially as disclosed in U.S. patent numbers: (1) U.S. Pat. No. 10,554,004 entitled "Sonotrode, device and method for producing a join" issued Feb. 4, 2020; and (2) U.S. Pat. No. 10,532,424 entitled "Device for welding components by means of ultrasound" issued Jan. 14, 2020, both Assigned to Telsonic Holding AG, which are hereby both incorporated by references in their entirety.

The distributor 112 may have a base 142 with an outer flap 146 adapted to engage with the inner side 140 of the sidewall 124 of the filter 106 such that the base 142 may be adjacent to the first section 128 of the extension 126. The flap 146 may extend upwardly and/or downwardly to engage with the inner side 140 of the sidewall. The base 142 may have a protrusion 144 extending towards the inner space within the filter 106. The protrusion 144 may form a cavity 162 sized to receive an inlet liquid injection member, as discussed in more detail below, such as an inlet needle to inject heated water into the filter 106. The base 142 may have a plurality of holes 148 to allow the heated water to pass therethrough to substantially distribute the water over the opening 154 of the filter 106. The size of the holes 148 may be less than the average size of the beverage ingredient 110. This may substantially prevent the beverage ingredient 110 from entering the protrusion area 144 thereby substantially preventing the beverage ingredient from clogging the inlet injection member, which can cause the brewing mechanism to malfunction.

The sidewall 124 may have one or more ribs 125 extending outwardly. The extending ribs 125 may be formed on the exterior side 127 of the sidewall 124 adjacent to the extension 126. As the filter 106 is inserted into the container 104, the extending ribs 125 may engage with the sidewall 118 of the container 104 to center the filter 106 relative to the container 104 such that the filter 106 may be substantially aligned with the filter 106 along the axis 102 of the pod 100. The distributor 112 may be placed over the beverage ingredient packed within the filter 106 and the flaps 146 may be engaged or sealed within the interior side 140 of the sidewall 124 of the filter 106 such that the beverage ingredient 110 may be substantially compact between the distributor 112 and the base 122. The distributor 112 may have a flange 146 with cutouts 147 around the circumference of the flange 146 to allow the outer area of the distributor 112 to flex and bend. The protrusion 144 may have an inverted bell like shape to enlarge the area of the cavity 162 adapted to receive the inlet member of the brewing mechanism. The enlarged cavity 162 may also allow the outer area of the distributor 112 to flex and bend more readily.

The manner in which the beverage ingredient is packed within the filter 106 may be predetermined to control the density of the beverage ingredient 110 therein to substantially prevent air pockets, gaps, and channels from forming within the ingredient 110 during manufacturing, shipping, handling, and during the brewing process. As a general rule, beverage ingredient 110 with greater density may require greater pressure to push the heated liquid through the beverage ingredient 110, which can extract more intense flavor from the beverage ingredient 110 in less time. Once the first section 128 of the filter 106 is separated from the rim 120, as discussed in more detail below, the distributor 112 may flex to substantially contain the ingredient 110 within the filter 106 to avoid forming air pockets therein. The lid 114 may be placed over the filter 106 and the outer edge 150 of the lid 114 may be sealed and/or bonded to the first section 128 of the filter 106. In particular, the lid 114 may be formed from a flexible liner with sufficient tensile strength to resist tearing due to the high pressure during the brewing process.

The pressure developed within the beverage ingredient 110 can determine the type of beverage brewed such as coffee under lower pressure and espresso under higher pressure. A number of other factors can determine the pressure developed within the beverage ingredient 110 such as the pressure and temperature of the heated water injected into the beverage ingredient, the grind size and density of the beverage ingredient, the size and number of holes 136 in the base 122 of the filter 106, the depth of the beverage ingredient, and etc. The base 122 may have a predetermined number of holes sized to allow the beverage to pass therethrough but substantially prevent the beverage ingredient packed within the filter 106 from passing through the holes due to pressure within the filter during the brewing process. For instance, the sidewall 124 may be substantially solid to direct most of the beverage, if not all, to pass through the holes 136 on the base 122. Moreover, the extending ribs 125 extending from the sidewall 124 may substantially maintain its shape under the desired brewing pressure conditions. The number and/or size of the holes 136 formed in the base 122 may be predetermined to provide sufficient resistance to flow of beverage to develop the desired brewing pressure within the beverage ingredient to brew a desired beverage. For example, to brew espresso under high pressure from about 6 to 15 bars, the coffee beans may be finely grounded where the average grind size may be from about 40 to about 450 microns, and to brew coffee under low pressure from about 1 to 4 bars, the coffee may be grounded more coarsely where the average grind size may be from about 500 to about 1,000 microns; and to substantially prevent the grinds from passing through the holes, the size of the holes 136 may be less than the average grind size of the coffee grounds. The holes may have a variety of shapes such as circular, square, rectangular, regular and irregular configuration.

Along with the size of the holes 136, the number of holes 136 provided in the base 122 may be predetermined to develop the desired pressure within the filter 106 to brew the intended beverage such as espresso or coffee. That is, the brewing mechanism may inject heated water into the pod 100 at a pressure up to about 19 bars but some of the pressure may be released through the coffee ground and through the filter 106 such that the espresso flavor beverage may be extracted from the finer coffee ground at about 8 bars, for example, with the difference of 11 bars of pressure being released, in this example. That is, the pressure within the filter may largely depend upon the size of the beverage ingredient and the size and number of holes 136. For instance, for low pressure coffee, coarser ground coffee may be packed within the filter 106 and the size and number of holes 136 may be greater than that of the holes 136 to brew espresso, and substantial pressure may be released through the coffee ground and through the filter 106 such that coffee may be extracted from the coarser coffee ground at about 3 bars, for example, with the difference of 16 bars of pressure being released.

In general, for low pressure coffee, the size of the holes 136 may be less than an average grind size or less than the lower end of the distribution of the grind sizes to brew coffee where the average grind size may be from about 450 to about 1,000 microns; and in particular from 500 to about 700 microns. Note that some soluble may have an average grind size of about 1,000 to 2,500 microns. For instance, coffee ground may have grind size distribution from 500 to 700 microns with an average or mean grind size of about 600 microns. With such grind size distribution and average, the size of the holes 136 to brew coffee may be less than about 600 microns or less than 500 microns to substantially prevent coffee ground from passing through the holes and to release the pressure within the coffee grounds to brew coffee. Alternatively, the pod 100 may include a paper filter between the holes 136 and the coffee ground, although not necessary, to allow the beverage to pass while preventing the smaller coffee sediments from passing therethrough during brewing process. Moreover, it is within the scope of the invention to have the size and number of holes 136 in the base 122 to be independent of the grind size of the beverage ingredient 110 where the size of the holes 136 may be sized to substantially prevent the ingredient sediment from passing through the holes 136.

FIG. 1B shows at least one retainer wall 132 extending from the base 122. In particular, the base 122 may have a plurality of retainer walls 132 extending therefrom with layers of retainer walls 132 forming a pathway between two adjacent retainer walls 132, and with a plurality of slits 134 on each of the retainer wall 132, as discussed in more detail below. The retainer walls 132 may have distal ends 135 that contour the shape of the inner side of the base 116 of the container 104.

Figure 1D:
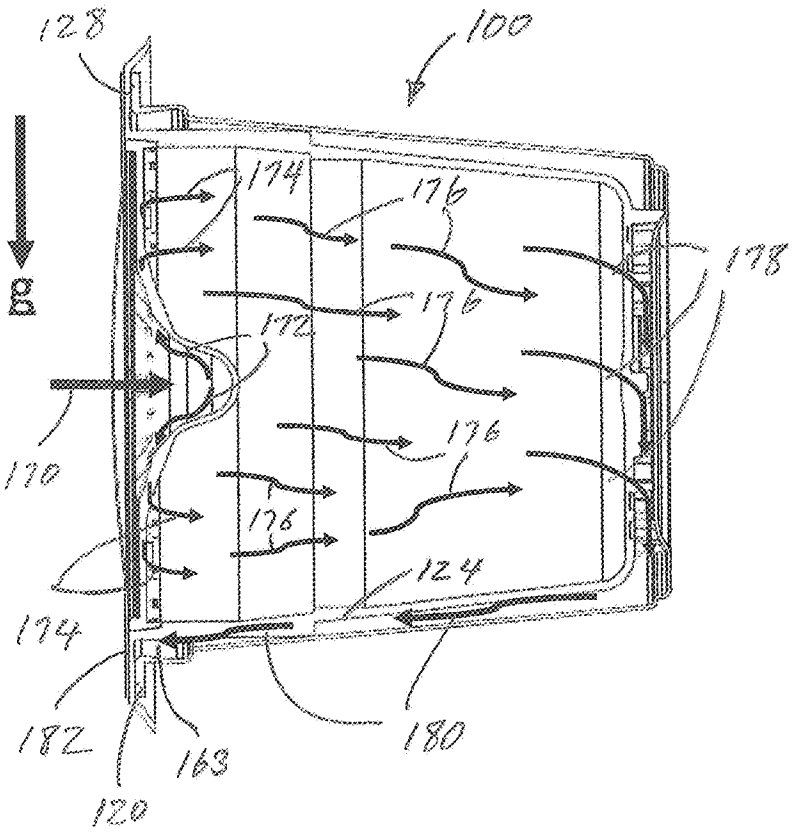
FIG. 1D shows a cross-sectional view of the assembled pod in a brewing orientation.
Figure 1C:
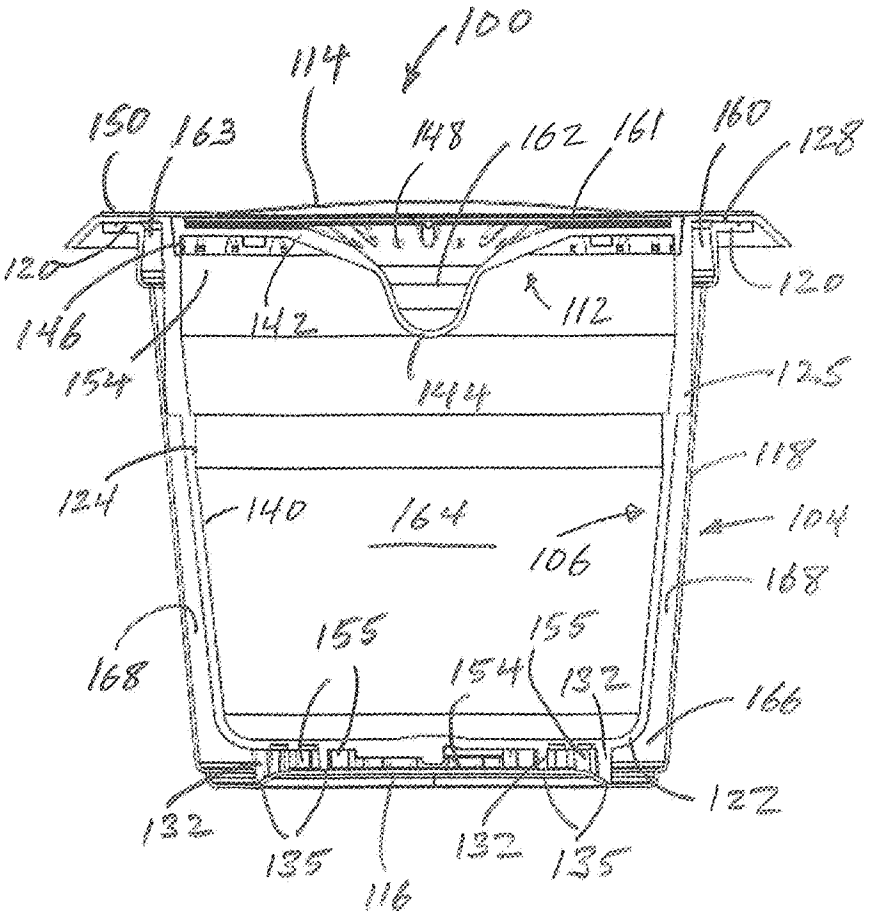
FIG. 1C shows a cross-sectional view of the assembled pod without the beverage ingredient.

FIG. 1C shows a cross-sectional view of an assembled pod 100 without the beverage ingredient 110 where the interior of the container 104 may be divided into different chambers including the cavity 162 that extends outwardly to form the gap 161 between the lid 114 and the base 142 of the distributor as discussed above; and a first chamber 164 and a second chamber 166. The first chamber 164 may be generally defined as the interior space of the filter 106 or the space between the distributor 112 and the second chamber 166. The second chamber 166 may be generally defined as the space between the filter 106 and the container 104. The cavity 162 may be adapted to receive an inlet member (not shown) from a high or low pressure brewing mechanism and the heated water from the inlet may flow along the gap 161 to distribute the heated water in a substantially even manner through the holes 148 to more evenly mix with the beverage ingredient 110 to extract the beverage such as espresso or coffee from the ingredient 110. The base 122 of the filter 106 may be in close approximation to the base 116 of the container 104 to enlarge the first chamber 164 to pack about 6 to 18 grams of coffee ground to brew about 0.8 to about 3 oz of espresso or 6 to 14 oz of coffee. The size and number of holes 136 provided on the base 122 may be predetermined to brew a desired beverage such as espresso or coffee. The circumference or diameter of the sidewall 124 of the filter 106 may be less than the circumference or diameter of the sidewall 118 of the container 104 such that a pathway 168 may be provided between the two sidewalls 124 and 118 around the circumference of the sidewall 124 of the filter 106.

The assembled pod 100 may have the lid 114 as a proximal end, and the base 116 of container 104 may represent a distal end of the pod 100. The pod 100 may have a first pathway 155 along the distal end of the pod, and a second pathway 168 from the distal end to the proximal end of the pod. In particular, the first pathway 155 may be formed between the base 122 of the filter and the base 116 of the container 104, and a second pathway 168 may be formed between the sidewall 124 of the filter and the sidewall 118 of the container. The first pathway 155 may be formed by extending the distal ends 135 of the individual retainer walls 132 from the base 122 such that distal ends 135 may substantially contour the inner side 154 of the base 116 of the container 104 thereby minimizing the gap between the distal ends 135 and the base 116 or have the distal end 135 engage with the base 116 of the container 104. As discussed in more detail below, the individual retainer walls 132 may be spaced apart from each other thereby forming the first pathways 155 between the adjacent walls 132 with the holes 136 formed in the base 122 along the pathway between adjacent walls. In particular, the holes 136 may be formed between adjacent walls 132, and the walls 132 may have the slits 134 to allow the first pathways 155 to traverse across from the inner wall to the outer walls.

The extending ribs 125 may engage with the sidewall 118 of the container 104 to center the filter 106 relative to the container 104. This may allow the assembled pod 100 to substantially maintain the second pathway 168 that is substantially uniform between the two sidewalls 118 and 124 around the circumference of the sidewall 124. The second pathway 168 may extend from the distal end of the filter to the proximal end of the pod 100. In particular, the sidewall 124 may generally extend upwardly from the base 122 in a taper or expanding manner relative to the longitudinal axis 102, in part, to enlarge the size of the first chamber 164 to be able to pack more beverage ingredient. As the sidewall 124 extends upwardly towards the proximal end of the pod 100, the sidewall 124 may extend in a substantially parallel manner relative to the longitudinal axis 102 to enlarge a gap 163 between the rim 120 and the sidewall 124 at the proximal end. As discussed in more detail below, the enlarged gap area 163 may slow down the flow of the beverage flowing along the second pathway 168 so that the beverage may drain from the pod more smoothly thereby minimizing spattering of the beverage as it drains.

The extending ribs 125 may also engage with the sidewall 118 of the container 104 during the brewing process such that the lateral force applied to the interior side 140 of the sidewall 124 may transfer to the sidewall 118 of the container 104. During the brewing process, the pod 100 may be placed in the brewing chamber (not shown), which includes a holder (not shown) adapted to receive the pod 100. The holder may support the outer contour of the container 104 such as the sidewall 118 and the base 116, which in turn supports the sidewall 124 and the retainer walls 132 of the filter 106. This may substantially prevent the filter 106 from deforming along the sidewall 124 and the base 122 due to the internal high pressure within the filter 106, such as when brewing high pressure beverages like espresso. That is, the extending ribs 125 between the two sidewalls 124 and 118, and the retainer walls 132 between the two bases 122 and 116 may substantially transfer the stress on the filter 106 to the holder in order to substantially maintain the first and second pathways 155 and 168 open. Note that various components of the pod 100 may be assembled in a variety of different orders, and the assembly process is not limited to the steps discussed above.

FIG. 1D shows the pod 100 in a substantially horizontal position in reference to the gravitational direction g, which may be a brewing position of the pod 100. As discussed in more detail below, during the brewing process, the heated water may be injected into the pod 100 through the lid 114 and into the cavity 162 as indicated by the direction arrow 170; and thereafter, the heated water may flow along the following path within the pod 100: (1) as indicated by the direction arrows 172, the protrusion 144 may redirect the heated water towards the lid 114 or the proximal end; (2) as indicated by the direction arrows 174, the heated water may flow along the gap 161 between the lid 114 and the distributor 112 and exit through the holes 148 in the base 142 of the distributor 112 and mix with the beverage ingredient 110 within the first chamber 164; (3) as indicated by the direction arrows 176, the heated water may extract the beverage from the beverage ingredient 110 and the pressure from the heated water injected into the cavity 162 may direct the beverage towards the distal end 122 of the filter 106; (4) as indicated by the direction arrows 178, the beverage may then pass through the holes 136 on the base 122 and flow along the first pathway 155, as discussed in more detail below; and (5) as indicated by the direction arrows 180, with the pod 100 in the substantially horizontal orientation, the gravity may direct the beverage to flow along the second pathway 168, which may be along the six O'clock position of the pod 100 when viewing the first extension 128 as a face on a clock, and the bottom 182 of the first extension 128 may represent the six O'clock position. Note that it is within the scope of the invention to have the pod in a variety of other orientations rather than on a horizontal orientation such as facing downwards or upwards, where in the upward position, the pressure within the pod may force the beverage upwards to drain from the gap.

The external ribs 125 may maintain a uniform second pathway 168 such that the pod 100 may be brewed in any rotational orientation about the first extension 128. In other words, the pod may be inserted into a brewing mechanism in any rotational direction since the gap in the second pathway 168 is substantially similar around the circumference of the two sidewalls 118 and 124. As discussed above, the gap 163 between the proximal end of the sidewall 124 and the rim 120 may be enlarged to slow down the flow of beverage near the proximal end so that the beverage may drain more smoothly from the pod 100 via a gap formed between the extension 126 and the rim 120, as discussed in more detail below. Note that the sidewall 124 of the filter 106 may not have holes to substantially direct the beverage to flow towards the distal end 122 of the filter 106 and substantially prevent the beverage from passing through sidewall 124. However, it is within the scope of the invention to have holes in the sidewall 124 depending on the application. In addition, the distributor 112 may or may not be utilized depending on the application. If the distributor is not utilized, then the heated water from the brewing chamber may be directed towards the beverage ingredient 110.

Figure 2B:
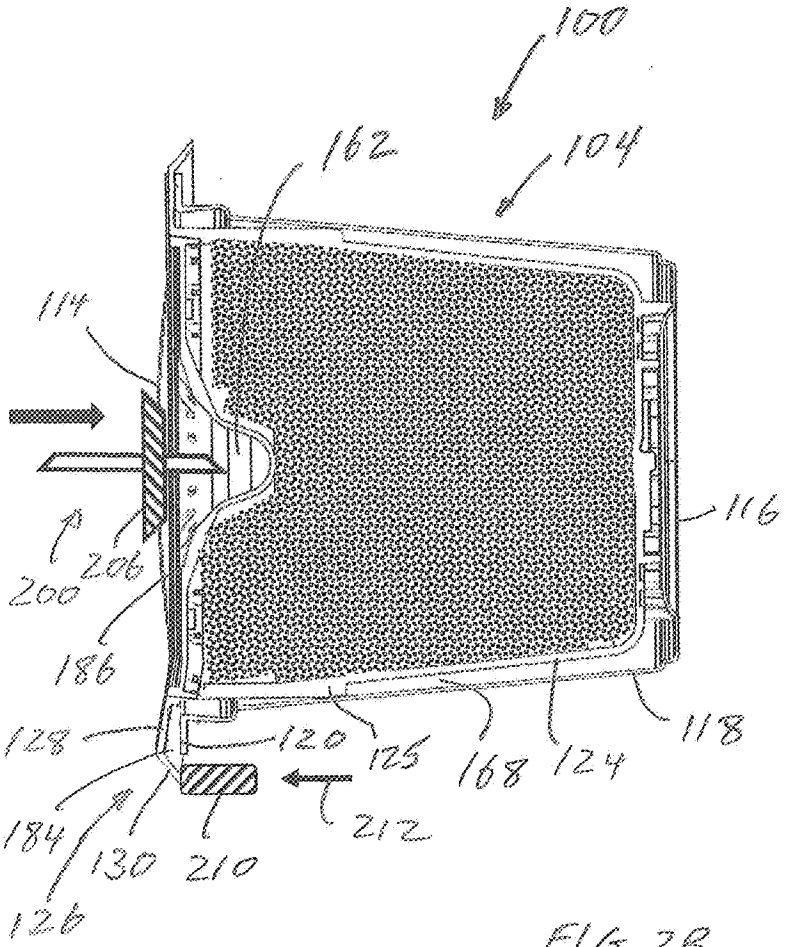
FIG. 2B shows a cross-sectional view of the pod with the inlet member piercing through the lid and the detaching member separating the extension of the filter from the rim of the container to form a gap therebetween.
Figure 2A:
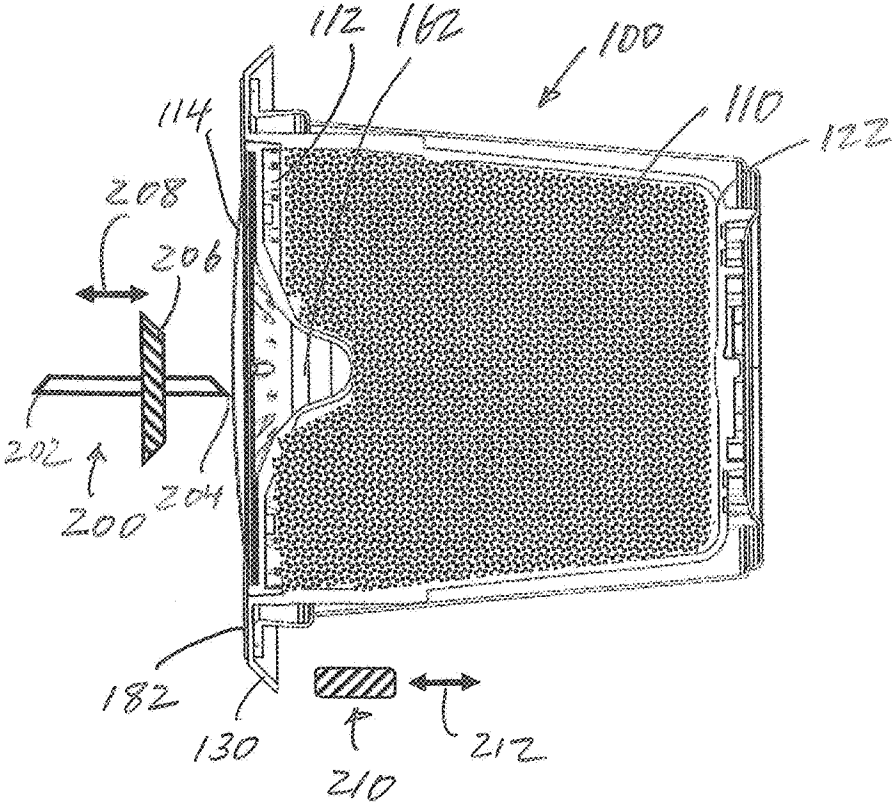
FIG. 2A shows a cross-sectional view of the pod in a brewing orientation juxtaposed to an inlet member and a detaching member.

FIGS. 2A through 2D show cross-sectional views of the pod 100 in different stages to illustrate a manner and method of brewing a beverage with the pod 100. In this example, FIG. 2A shows the pod 100 in a substantially horizontal position or brewing orientation as discussed above in reference to FIG. 1D, packed with beverage ingredient 110 within the first chamber 164. For example, the beverage ingredient 110 may be coffee ground to brew low pressure coffee with an average coffee grind size from about 500 microns to about 1,000 microns, or brew high pressure espresso with an average coffee grind size from about 40 microns to about 400 microns; and the size and number of holes 136 may be smaller than the average coffee grind size to substantially prevent the coffee ground from passing through the holes 136 in the base 122, but release the pressure within the first chamber 164. In the brewing orientation, the pod 100 may be juxtaposed to an inlet member 200 having an inlet end 202 and a tip 204 with a gasket 206 therebetween. The member 200 may be adapted to slide relative to the pod 100 as indicated by the double ended direction arrow 208, or the pod may be adapted to slide relative to the member 200, or both elements 100 and 200 may be adapted to slide or move relative to each other simultaneously or sequentially. The member 200 may be positioned relative to the pod 100 such that the tip 204 may be juxtaposed to the lid 114 in order to penetrate the cavity 162 of the distributor 112. The pod 100 may also be juxtaposed to a detaching member 210 position behind the second extension 130 at about the six O'clock position 182, as discussed above in reference to FIG. 1D, and in reference to the gravitational direction g. The detaching member 210 and the pod 100 may be adapted to slide relative to each other as indicated by the double ended direction arrow 212 where one or both elements 100 and 210 may move relative to each other simultaneously or sequentially.

FIG. 2B shows that to begin the brewing process, the inlet member 200 may pierce, puncture, or cut through the lid 114, or use any other apparatus or method known to one skilled in the art, and the tip 204 may rest within the cavity 162, and the gasket 206 may engage with the lid 114 surrounding the member 200 to substantially prevent the water from leaking out of the opening between the member 200 the lid 114 formed by the punctured hole within the lid. The detaching mechanism 210 may move towards an extended position as indicated by the direction arrow 212 to engage with the second extension 130 to separate the first extension 128 from the rim 120 near the six O'clock position 182 thereby forming a gap 184 between the extension 126 and the rim 120 that may extend from about four O'clock to about eight O'clock positions; and in particular from about five O'clock to about seven O'clock positions. The second section 130 may taper towards the base 116 of the container 104 such that the underside of the second section 130 may form a concave shape or hook to allow the detaching member 210 to engage with the underside of the second section 130 to separate the first extension 128 from the rim 120 more consistently.

FIG. 2B also shows that the diameter of the gasket 206 may be smaller than the diameter of the opening 186 forming the cavity 162 such that the force applied by the gasket 206 onto the lid 114 may not directly transfer to the distributor 112 to minimize the resistance upon the extension 126 to allow the detaching mechanism 210 to separate the first extension 128 from the rim 120 and to substantially maintain the gap 184 opening. The newly formed gap 184 may form a part of the second pathway 168 between the two sidewalls 118 and 124 and also between the adjacent extending ribs 125 to allow the beverage formed within the pod 100 to flow along the second pathway 168 and drain through the gap 184, as discussed in more detail below.

Figure 2D:
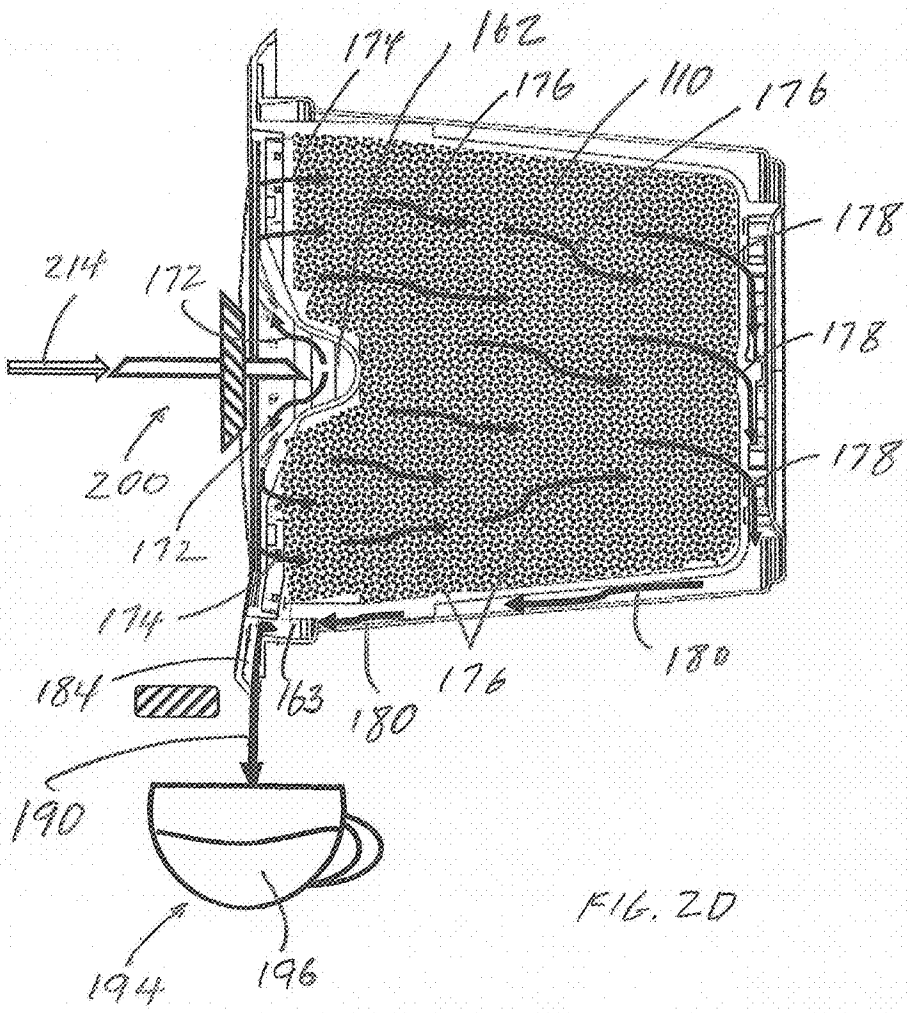
FIG. 2D shows the pod brewing in a substantially horizontal position and draining the beverage unobstructed by the brewing mechanism.
Figure 2C:
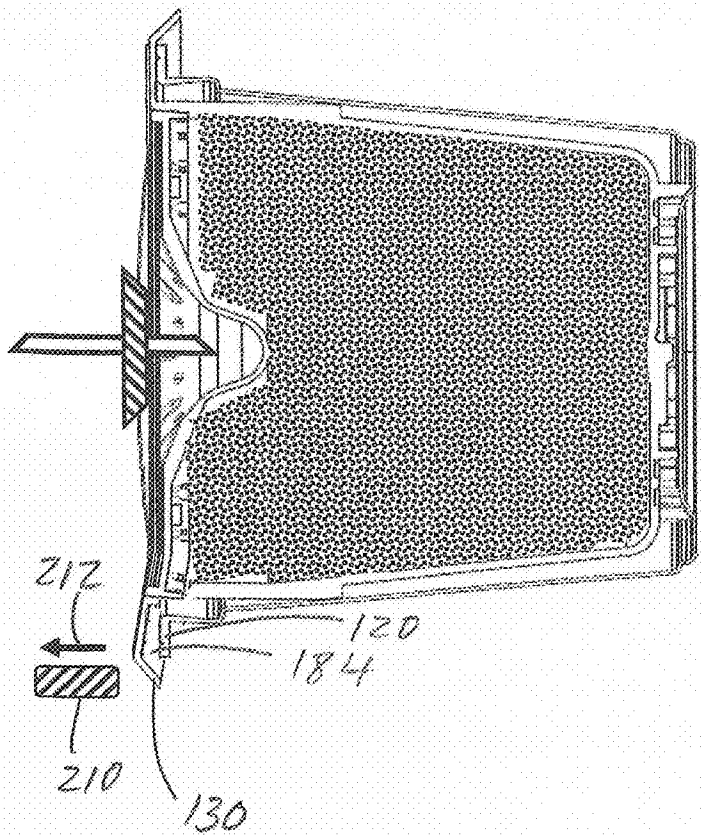
FIG. 2C shows the detaching member being on the opposite side of the lid to not interfere with the path of the beverage draining from the gap between the extension and the rim.

FIG. 2C illustrates that as the detaching member 210 moves further towards the inlet member 200 as indicated by the direction arrow 212, the second extension 130 may flex to allow the detaching member 210 to pass and rest on the opposite side of the extension such that the detaching member 210 may not interfere with the beverage draining out of the gap 184. Once the gap 184 is formed, a combination of the rim 120 and the concave shape of second extension 130 that extends downwardly may act as a spout to allow the beverage to pour from the gap 184 in a smooth manner to minimize spattering of the beverage. This may provide a clear path for the beverage to drain from the pod 100 without coming in to contact with the brewing mechanism to avoid contaminating the beverage, as discussed in more detail below.

FIG. 2D shows the inlet member 200 injecting heated water 214 into the cavity 162. Depending on the application, the heated water 214 may be provided at a low pressure from about 1 to about 4 bars and/or at a high pressure from about 6 to 15 bars. In reference to FIG. 1D, the heated water 214 may flow along the path as indicated by the direction arrows 172 and 174, and the beverage 196 extracted from the beverage ingredient 110 may flow along the path as indicated by the direction arrows 176, 178, and 180, and drain out of the gap 184 as indicted by the direction arrow 190 and pour the beverage 196 into a mug 194. In particular, the flow of the beverage 196 may be controlled to drain smoothly from the pod 100 based on the following: (1) the beverage 196 flowing along the first pathway 155 may be controlled based on the ratio of the slits 134 in the retainer walls 132 being aligned compared to slits 134 being staggered; (2) during the brewing process, the extending ribs 125 may substantially maintain the second pathway 168 uniformly open from the distal end to the proximal end, as discussed in reference to FIG. 1C; (3) the gap 163 in the proximal end of the pod 100 between the rim 120 and the sidewall 124 may be enlarged where the greater opening may slow down the beverage 196 to flow more smoothly near the proximal end along the second pathway 168; and (4) once the gap 184 is formed, the combination of the rim 120 and the concave shape of second extension 130 that extends downwardly may act as a spout to allow the beverage to pour from the gap 184 in a smooth manner to minimize spattering of the beverage. Accordingly, once the beverage 196 passes through the holes 136, the beverage 196 may flow along the first and second pathways 155 and 168, respectively, in a controlled and smooth manner, and also drain smoothly via the gaps 163 and 184 indicated by the direction arrows 178, 180, and 190; and pour into the mug 194 unobstructed by the brewing mechanism to substantially avoid contaminating the beverage and the brewing mechanism. In addition, the slits 134 in the retainer walls 132 may form a second stage or multiple stages of filtering as the beverage 196 flows along the first pathway 155, as discussed above, to brew a more cleaner tasting beverage with less sediment. Accordingly, the pod 100 may be brewed in a substantially horizontal position to brew and drain the beverage from the pod unobstructed by the brewing mechanism.

In reference to FIGS. 1A and 1C, the pod 100 may be assembled in a variety of ways. For example, the opening 160 of the container 104 may be sized to receive the filter 106 such that the first section 128 may rest upon the rim 120 of the container 104. The first section 128 of the filter 106 may be releasably sealed to the rim 120 of the container 104. This may be done with the container 104 in the upright position, the proximal end facing upwards, utilizing a variety of sealing and ultrasonic welding methods such as torsional ultrasonic, spin, heat seal or ultrasonic welding method. The opening 154 of the filter 106 as defined by the first section 128 may receive the beverage ingredient 110 and may be tampered to minimize air pockets within the ingredient 110. The distributor 112 may be placed over the ingredient 110 and substantially enclose the opening 154 of the filter 106. The distributor 112 may have a cavity 162 as defined by the protrusion 144 adapted to receive an inlet member to inject liquid therein. Note that it is within the scope of the invention to have the flap 146 extending upwardly from the base 142 such that there is a sufficient distance between the lid 114 and the base 142 such that protrusion 144 and cavity 162 may not be needed. The lid 114 may be placed over the first section 128 and a circumference near the outer edge 150 of the lid 114 may be sealed to the first section 128 to hermetically seal the ingredient 110 within the pod 100. The lid 114 may be sealed to the filter 106 through a variety of methods using heat, adhesive, glue, and ultrasonic welding to hermetically seal the beverage ingredient 110 within the pod 100. The distributor 112 may have a plurality of ribs protruding toward the lid 114 to maintain a gap between the lid 114 and the distributor 112 such that the liquid injected into the cavity 162 may flow along the gap and drain through the holes 148 and mix with the beverage ingredient 110 there-underneath.

Figure 3B:
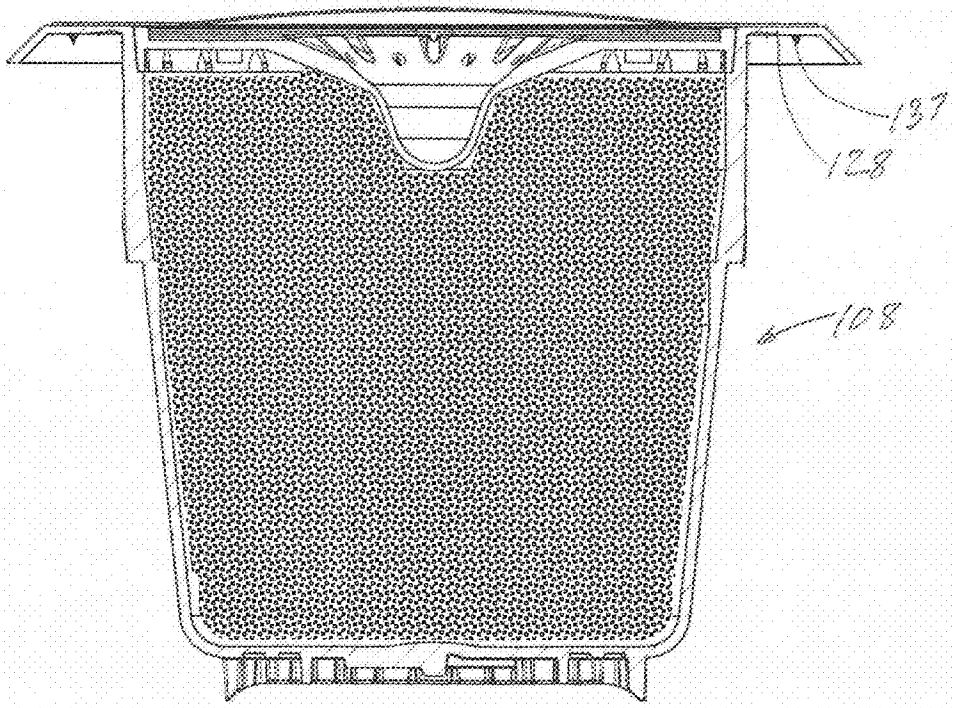
FIG. 3B shows the assembled filter.
Figure 3A:
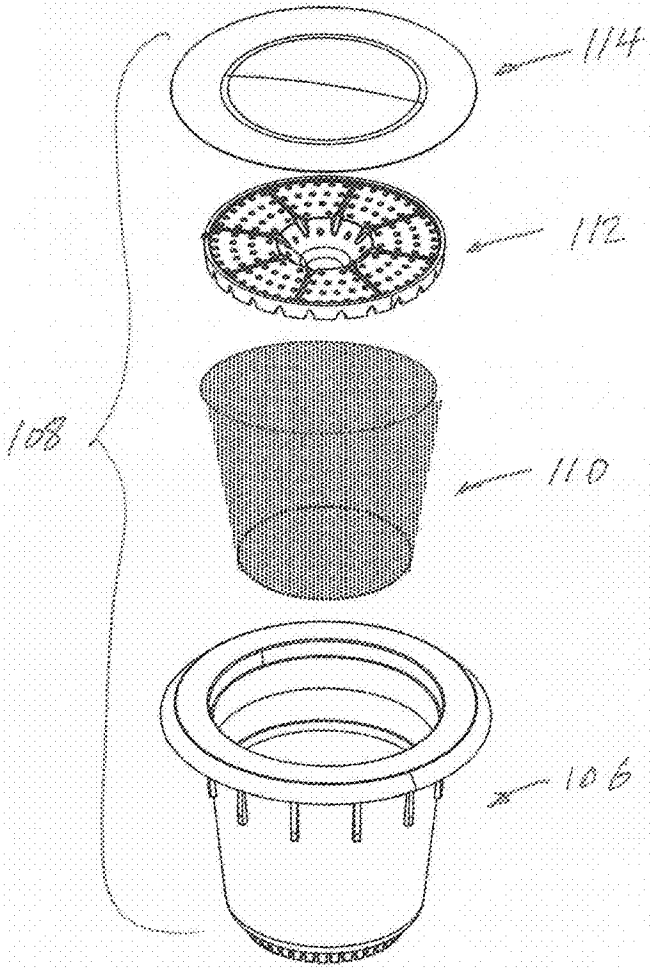
FIG. 3A shows an expanded view of an assembled filter.
Figure 3D:
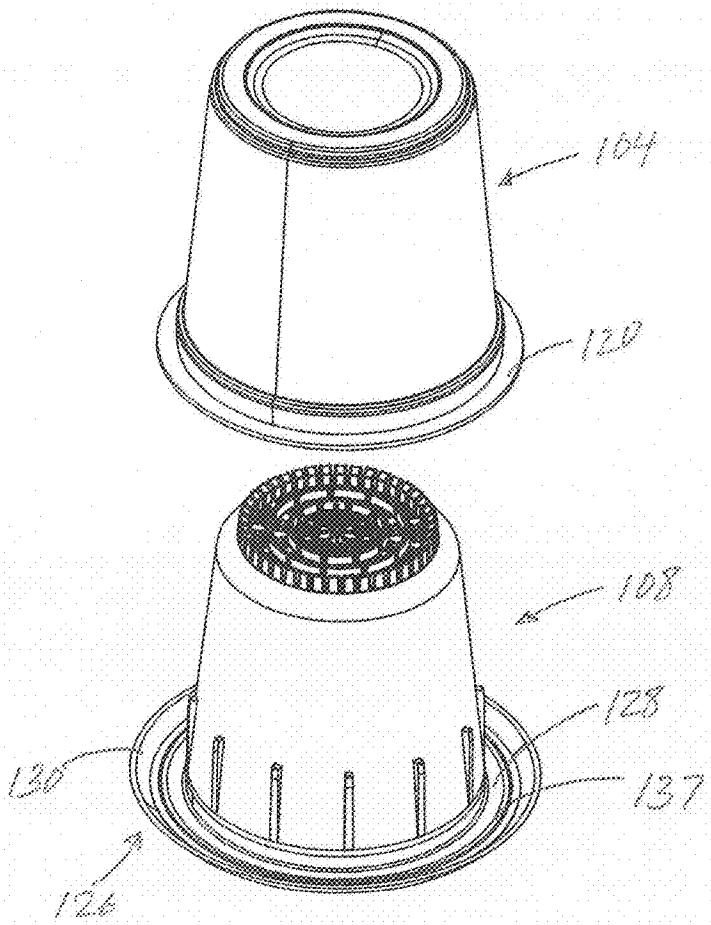
FIG. 3D shows an expanded view of a container and the assembled filter.
Figure 3C:
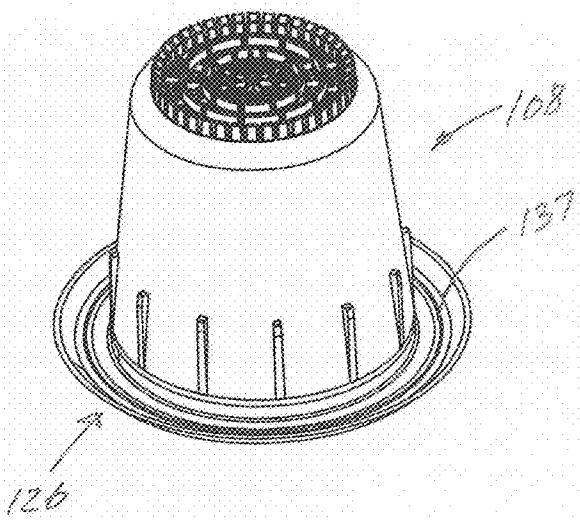
FIG. 3C shows the assembled filter in an inverted position.

FIG. 3A through 3D illustrates an alternative method of assembling the pod 100. FIGS. 3A and 3B show that the filter 106, beverage ingredient 110, distributor 112, and the lid 114 may be assembled first as discussed above in reference to FIG. 1A to form an assembled filter 108. FIG. 3B shows a cross-sectional view of the assembled filter 108 where the underside of the first section 128 may have an energy director 137 adapted to absorb the energy from the torsional ultrasonic welding method to melt and infuse with the rim 120 as discussed in more detail below. FIG. 3C shows that the assembled filter 108 may be flipped or inverted to have the extension 126 or the proximal end facing downwards showing the energy director 137. FIG. 3D shows that the container 104 may be inverted as well and placed over the assembled filter 108 such that the rim 120 of the container may be placed on top of the energy director 137. To releasably seal the extension 126 to the rim 120, a torsional welding system, may be utilized for example. In this process, a high-frequency vibrational energy may be transferred tangentially where the sonotrode activates the upper part and moves it horizontally in relative to the lower part. For example, the upper part may the container and the lower part may be filter or vice versa. The high vibration frequency may be from about 15 kHz to about 80 kHz, and in particular from about 15 kHz to about 25 kHz, and further about 20 kHz; and the vibration frequency may be applied from about 1 ms to about 1200 ms, in particular from about 1 ms to about 800 ms, and further for about 800 ms, where the vibration energy may be substantially transferred to the energy director 137 such that amplitude and the welding pressure may substantially melt the energy director 137 to releasably join and/or hermetically seal the first section 128 of the extension 126 to the rim 120 so that the extension 126 may separate from the rim 120 upon an application of sufficient force underneath the second section 130.

Figure 4B:
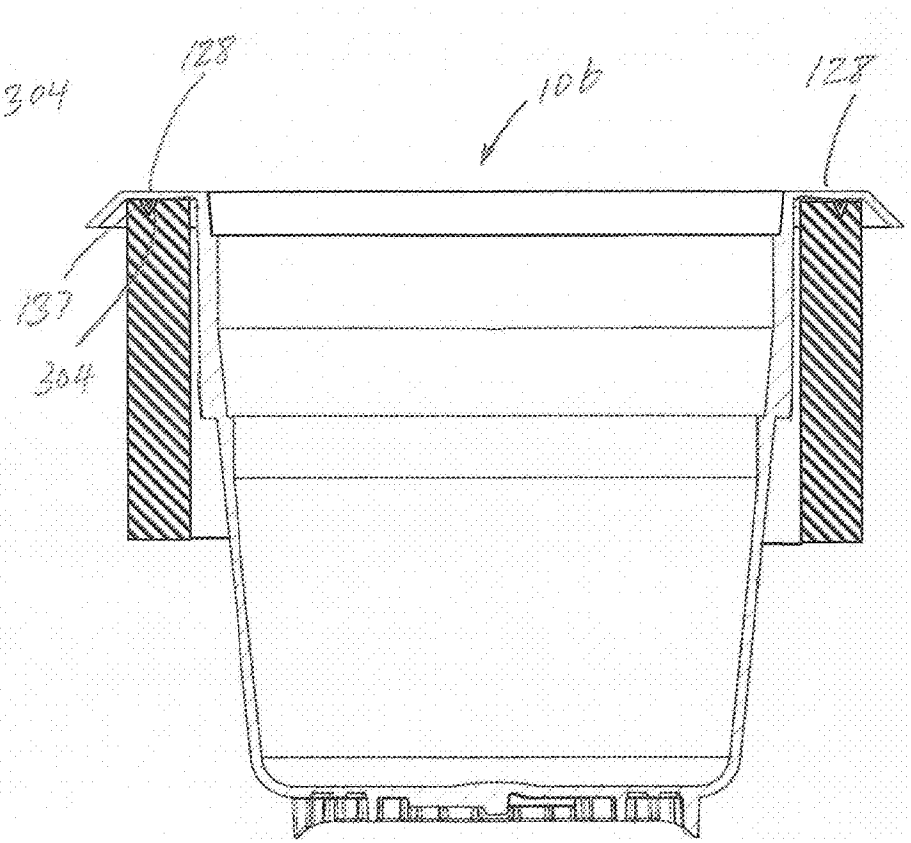
FIG. 4B shows the filter fully inserted into the lower well.
Figure 4A:
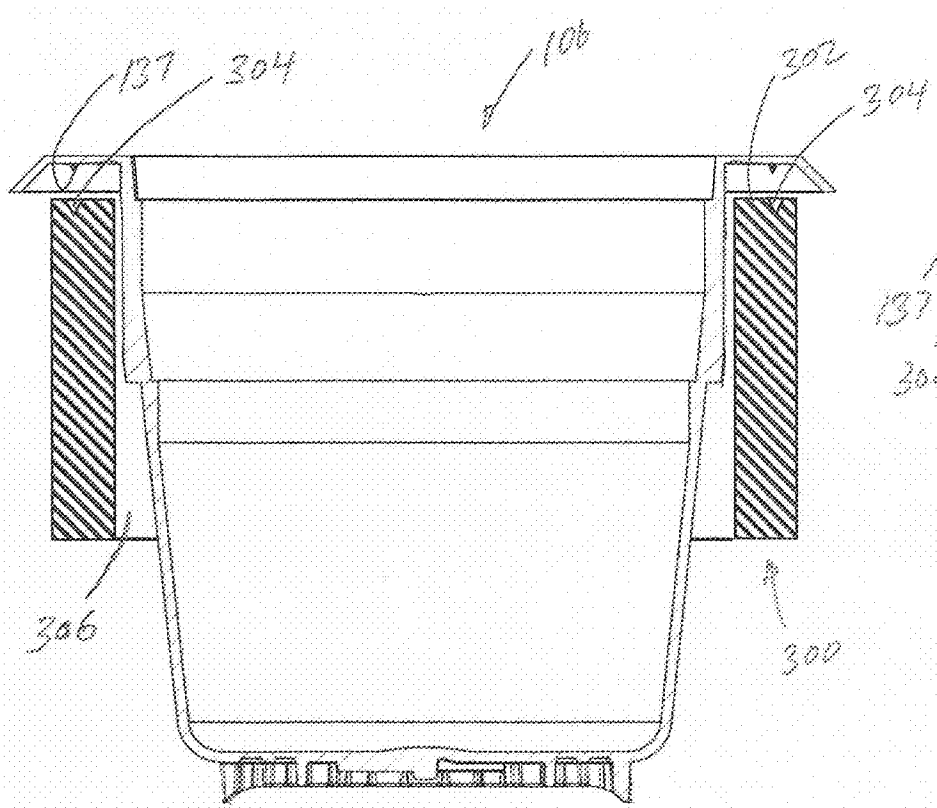
FIG. 4A shows a filter partially inserted into a lower well.
Figure 4D:
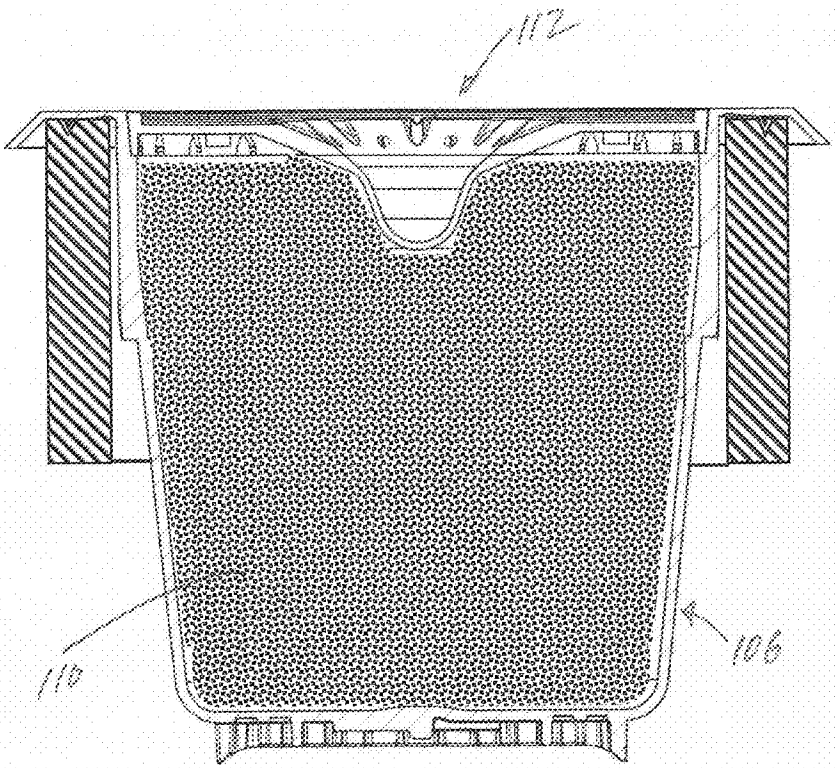
FIG. 4D shows a distributor placed juxtaposed to the beverage ingredient.
Figure 4C:
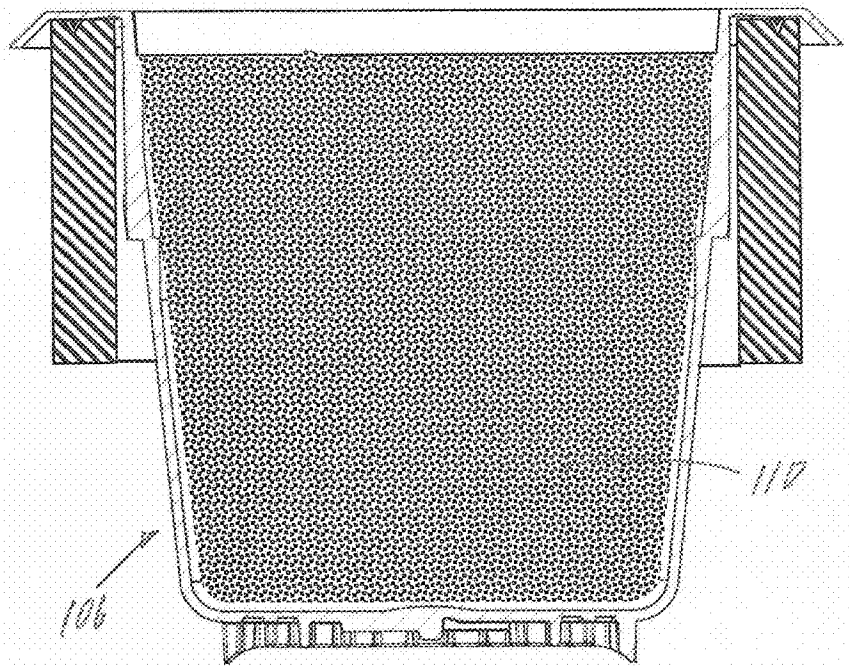
FIG. 4C shows the filter filled with beverage ingredient.
Figure 4F:
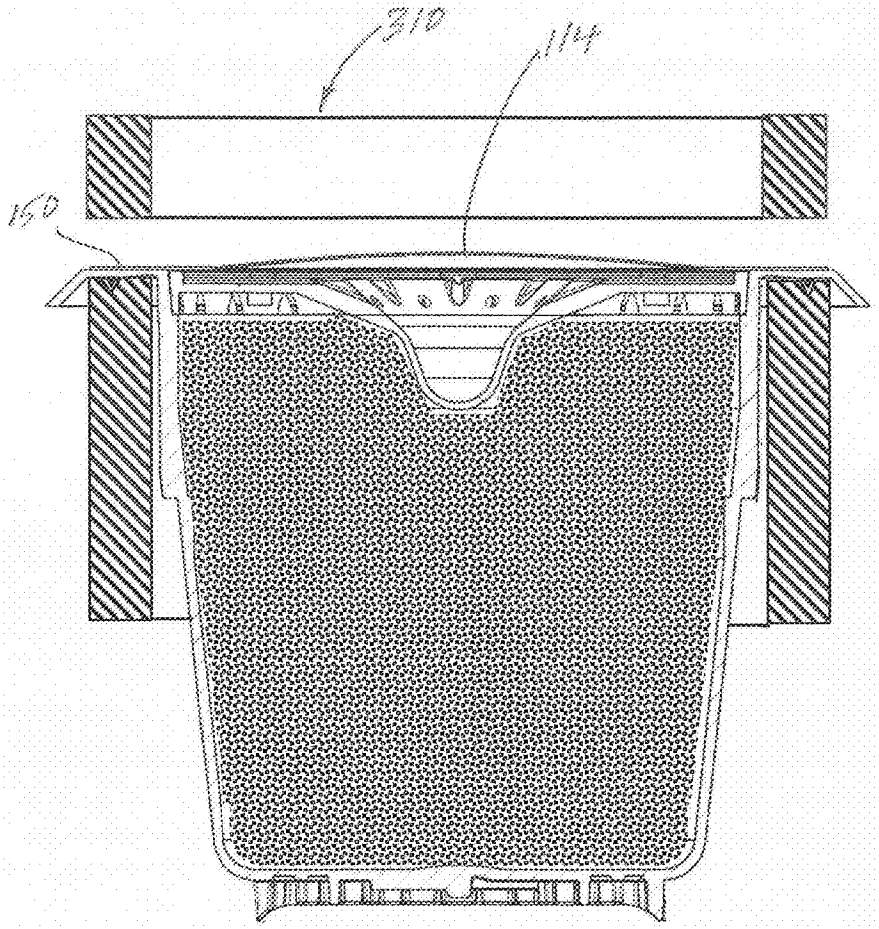
FIG. 4F shows an upper welding drum over the lid.
Figure 4G:
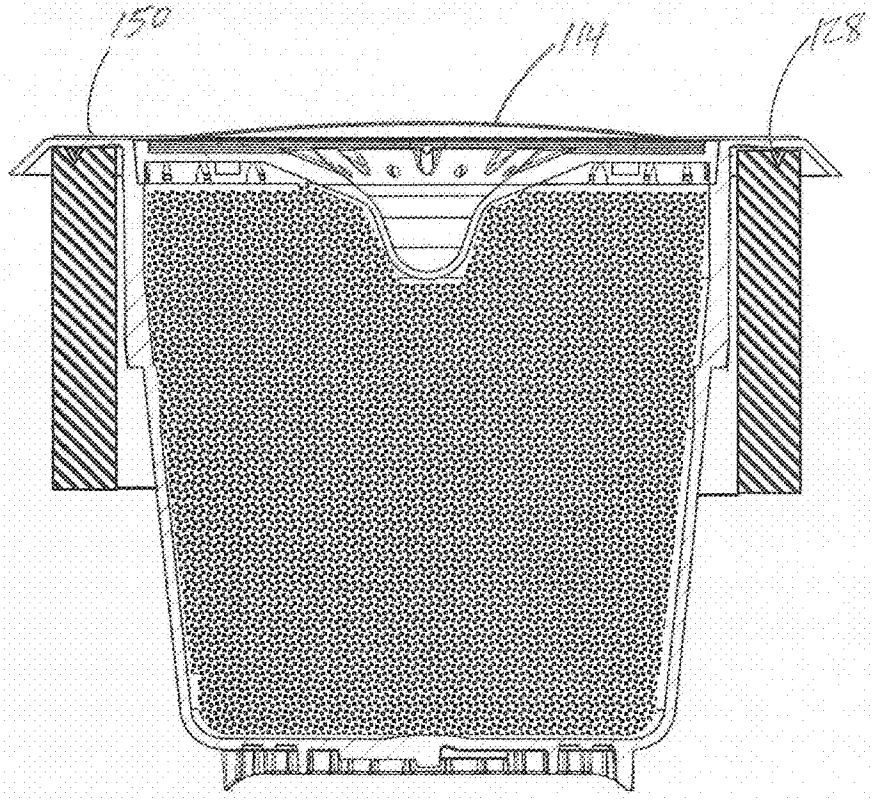
FIG. 4G shows the welding drum sealing the lid onto the extension of the filter.
Figure 4H:
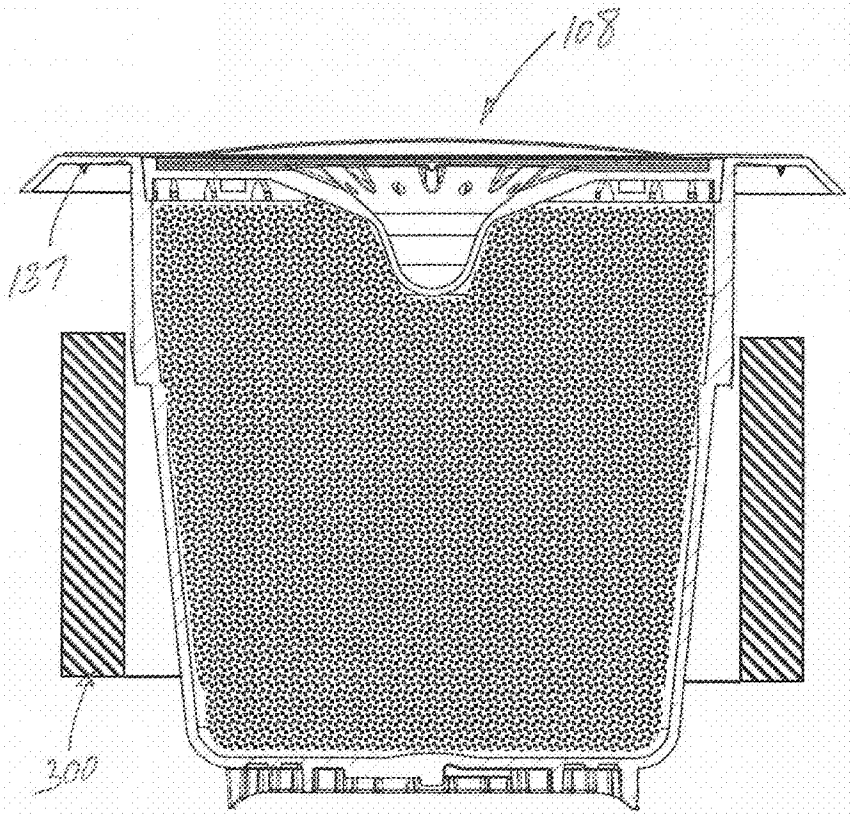
FIG. 4H shows the assembled filter removed from the lower well.
Figure 4G:
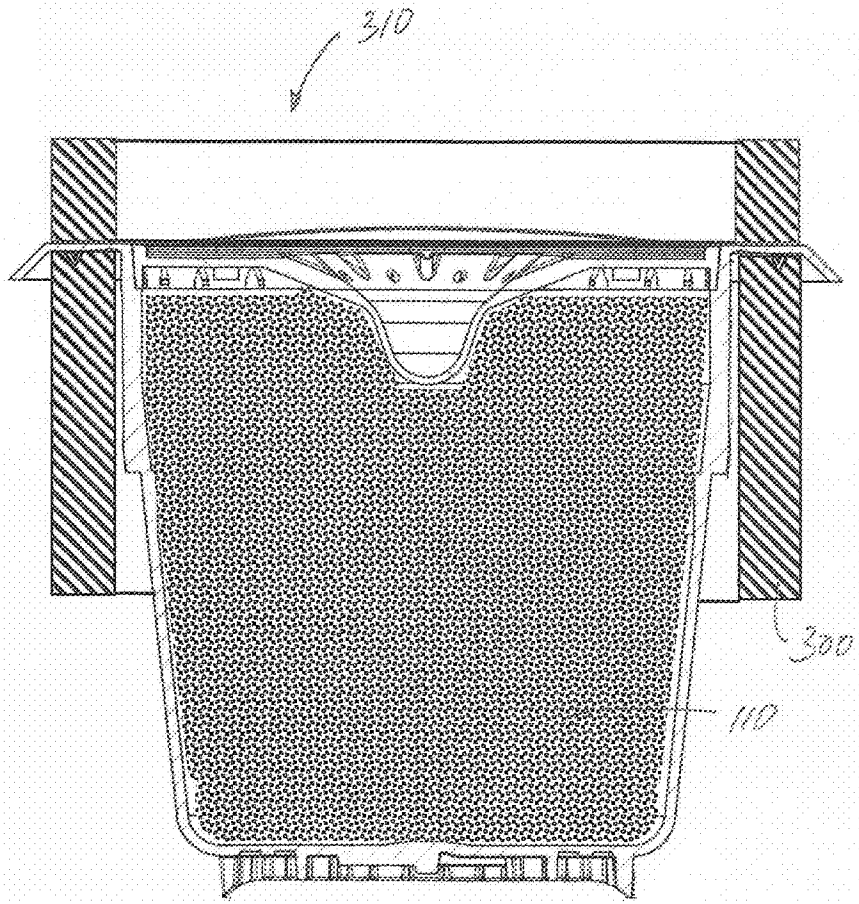

FIGS. 4A through 4K illustrates by way of example a number of stages to assemble the pod 100. FIGS. 4A and 4B illustrate a first stage where a lower well 300 may be adapted to receive the filter 106 in the upright position. The lower well 300 may have an upper lip 302 defining an opening 304 adapted to receive the distal end of the filter 106, and the upper lip 302 may have a cavity 306 adapted to receive the energy director 137. FIG. 4B illustrates that once the filter 106 is fully inserted into the lower well 300, the upper lip 302 may support the first section 128 and the energy director 137 may be within the cavity 306. The cavity 306 may substantially align the filter 106 in a proper position within the lower well 300. FIG. 4C illustrates a second stage where the beverage ingredient 110 may be placed within the filter 106. FIG. 4D illustrates a third stage where the distributor 112 may be placed into the filter 106 to enclose the opening 154 such that the distributor 112 may be juxtaposed to the beverage ingredient 110. FIG. 4E illustrates a fourth stage where the outer edge 150 of the lid 114 may be placed over the first section 128. FIGS. 4F and 4G illustrate a fifth stage where the upper welding drum 310 may be utilized to seal the outer edge 150 onto to the upper first section 128 of the filter 106. Note that a variety of methods know to one skilled in the art may be utilized to seal the lid 114 to the filter 106 such as adhesive, glue, heat, and ultrasonic weld to hermetically seal the beverage ingredient 110 from atmospheric gases such as oxygen. Note that the cavity 306 may substantially protect the energy director 137 from deforming due to the lid sealing process. FIG. 4H illustrates a sixth stage where the assembled filter 108 may be removed from the lower well 300 with the energy director 137 substantially in its original form.

Figure 4J:
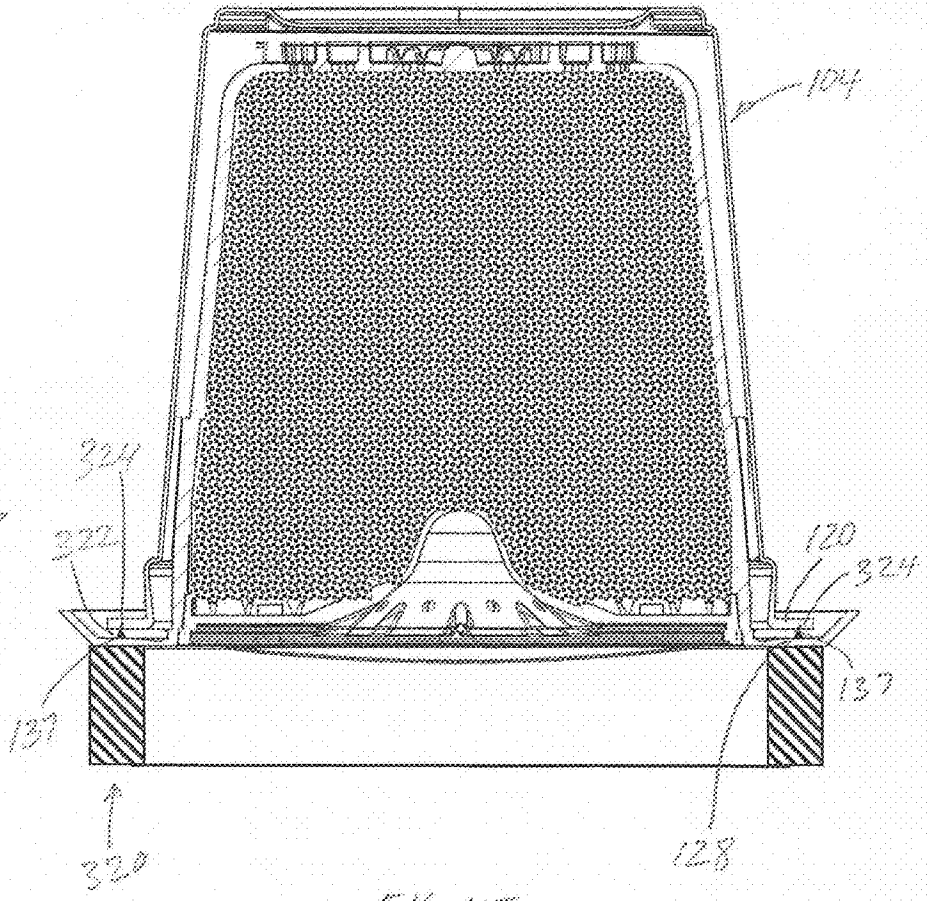
FIG. 4J shows a container placed over the filter.
Figure 4I:
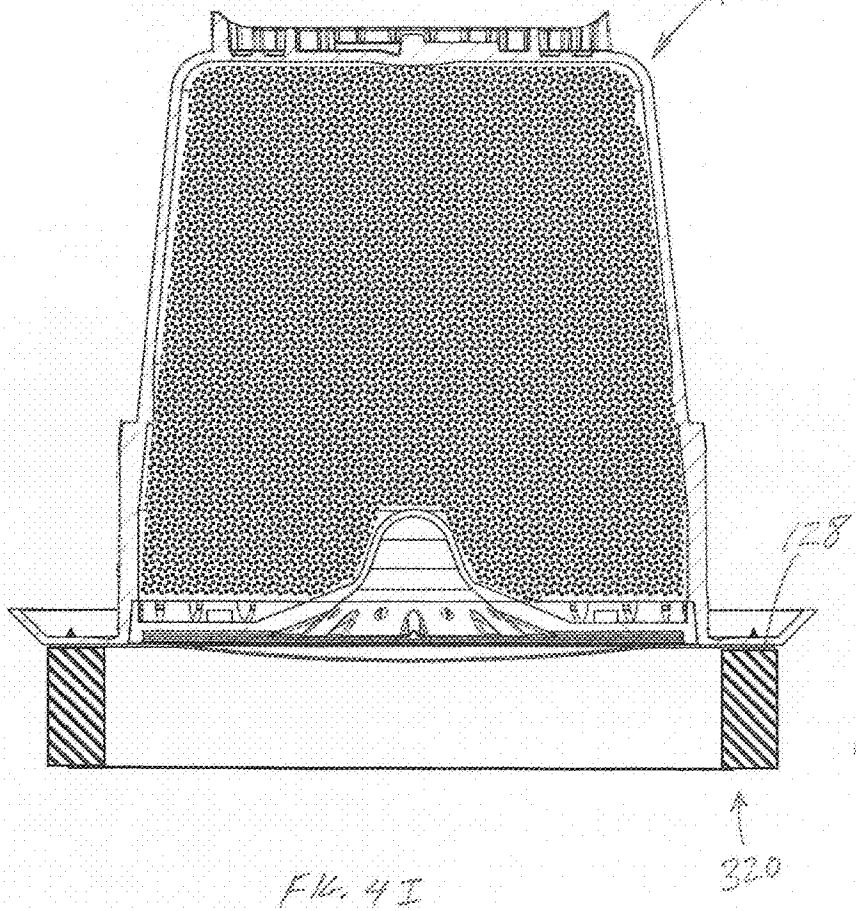
FIG. 4I shows the assembled filter in an inverted position placed over the lower well.
Figure 4L:
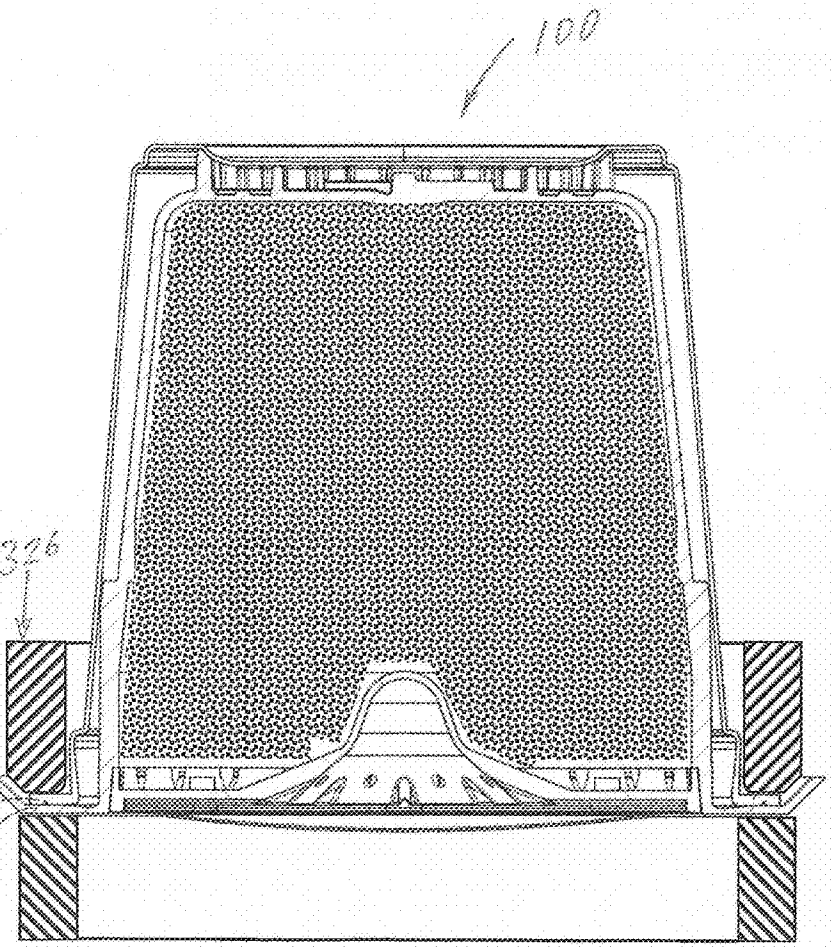
FIG. 4L shows the welding drum reliably sealing the rim to the extension of the filter.
Figure 4K:
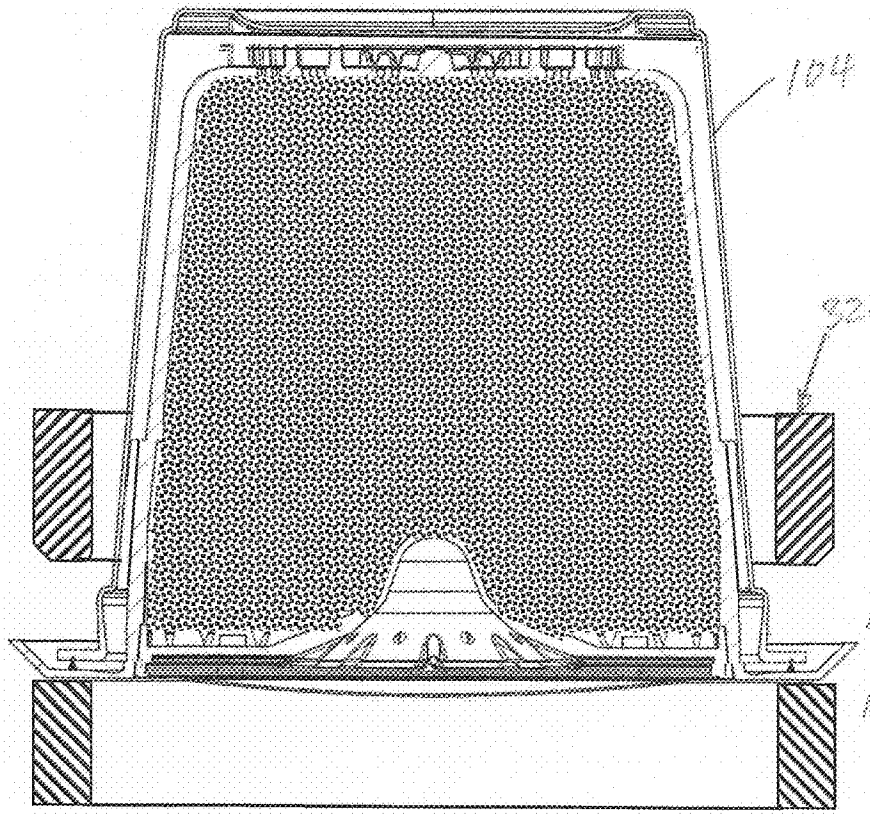
FIG. 4*k* shows a welding drum placed over the container.

FIG. 4I through 4L illustrate the process of releasably sealing the first section 128 to the rim 120. FIG. 4I illustrates a seventh stage where the assembled filter 108 may be inverted to have the extension 128 facing down and placed on a second lower well 320 to support the first section 128. FIG. 4J illustrates an eighth stage where the container 104 may be inverted and placed over the assembled filter 108 such that the rim 120 may rest upon the energy director 137 thereby forming a gap 322 between the rim 120 and the first section 128. Note that the rim 120 may have a cavity 324 adapted to receive the energy director 137, as discussed in more detail below, to align the rim 120 with respect to the energy director and to provide a more consistent seal between the rim 120 and the first section 128. FIGS. 4K and 4L illustrate a ninth stage where an ultrasonic weld such as the torsional ultrasonic welding drum 326 may be placed over the underside of the rim 120 and the vibrational energy may be directed to the energy director 137 to melt it in order to releasably join the first section 128 to the rim 120 thereby completing the assembly of the pod 100. Note that any combination of the frequency energy and the duration of the energy, as discussed above, may be applied to the energy director 137. The releasable joint may hermetically seal the first section 128 to the rim 120 around the circumference of the first section 128 yet the first section 128 may separate from rim 120 upon an application of a predetermined force underneath the second section 130. In particular, the first section 128 may separate in a substantially consistent manner around the circumference of the first section 128 to allow the pod 100 to be inserted into the brewing chamber in any orientation with respect to the lid 114.

Figure 4M:
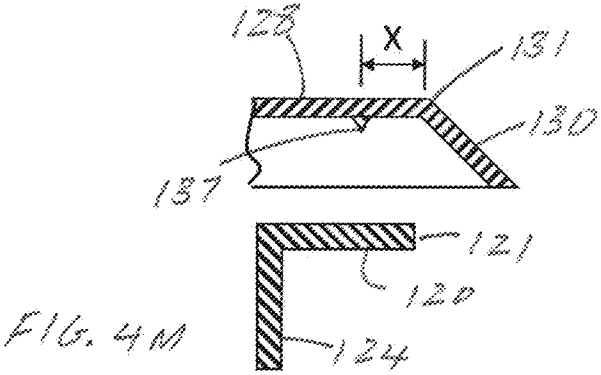
FIGS. 4M through 4R illustrate a number of alternative embodiments of providing an energy director between the extension and the rim.

FIGS. 4M through 4R illustrate alternative embodiments of providing an energy director 137 between the first section 128 and the rim 120. FIG. 4M shows an enlarged view of the energy director 137 protruding downwardly from the underside of the first section 128 of the filter 106 in reference to FIG. 3B discussed above. The energy director 137 may be located at about distance X from the outer circumference of the first section 128 as indicated by the reference numeral 131 such that once the filter 106 is assembled to the container 104, the energy director 137 may infuse to the rim 120 closer to the outer edge 121 than the sidewall 124 of the container 104. This may provide more leverage upon the first section 128 as force is applied to the underside of the second section 130 to allow the first section 128 to more readily separate from the rim 120.

Figure 4N:
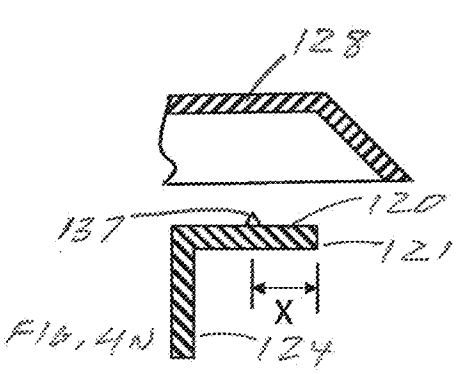
Figure 4O:
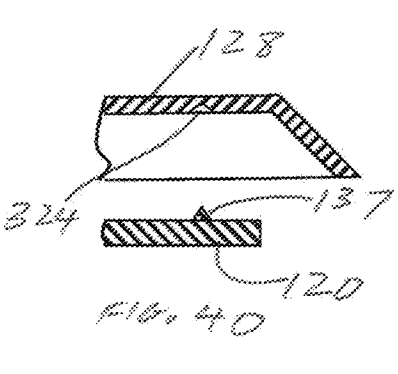
Figure 4P:
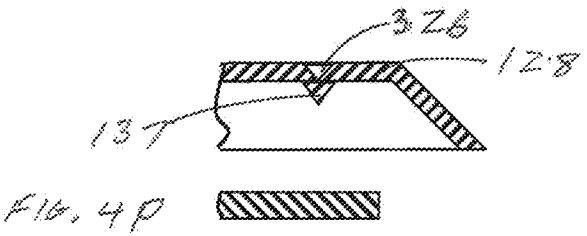
Figure 4Q:
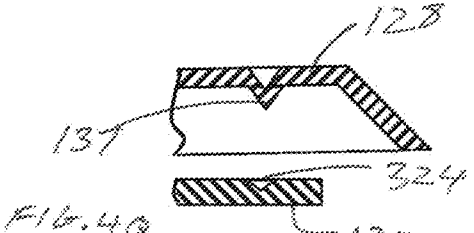
Figure 4R:
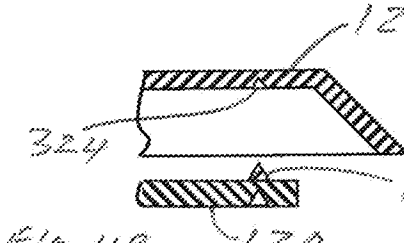

FIG. 4N illustrates that the energy director 137 may be provided on a variety of other locations such as on the rim 120 located at about the midpoint between the outer edge 121 and sidewall 124 of the container. Note that it is within the scope of the invention to provide the energy director to infuse the first section 128 to the rim anywhere along the rim. FIG. 4O illustrate that a cavity 324 may be provided on either the first section 128 and/or the rim 120 where the cavity 324 is positioned to receive the energy director 137 to concentrate the infused area and/or to align the first section 128 relative to the rim 120 in a consistent manner. FIG. 4P illustrates that the upper side of the first section 128 may be stamped thereby causing a cavity 326 to form which in turn protrudes out the underside to form the energy director 137. FIG. 4Q illustrates a combination of stamping the first section 128 to form the energy director 137 and having the cavity 324 on the rim 120. FIG. 4R illustrates a combination of having the stamping on the rim 120 to form the energy director 137 and the cavity 324 in the first section 128. Accordingly, it is within the scope of the invention to utilize a variety of a combination of the energy director 137 and/or the cavity 324 as disclosed herein along with methods known to one skilled in the art.

Figure 4S:
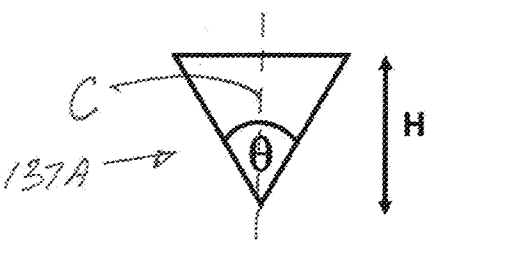
FIG. 4S illustrates an enlarged view of the energy director.
Figure 4T:
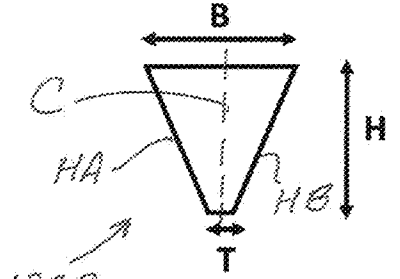
FIG. 4T illustrates an enlarged view of an alternative energy director.
Figure 4U:
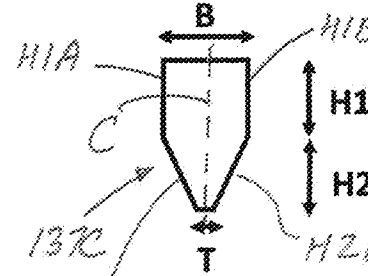
FIG. 4U illustrates an enlarged view of another energy director.

FIGS. 4S, 4T, and 4U illustrate a variety of different shapes the energy director 137 may have. For instance, FIG. 4S illustrates an energy director 137A having a triangular shape with an apex angle θ in the bottom corner with a height H. The apex angle θ may be from about 30° to about 90°; and in particular about 50° to about 70°, and further about 60°. The height H may be from about 0.30 mm to about 0.80 mm; and in particular about 0.50 mm. In particular, the energy director 137 may be isometric along a center line C substantially parallel with an axis H. That is, the shape of the energy director 137 may be folded along the center line C, and the two sides may be a substantially mirror image of each other.

FIG. 4T illustrates an energy director 137B may have a trapezoidal shape with four sides where two sides identified as sides B and T may be substantially parallel relative to each other, and the two opposite sides identified as sides HA and HB may have substantially the same length. In particular, the energy director 137B may be isometric along a center line C. The energy director 137B may have a base length B from about 0.30 mm to about 0.80 mm, and in particular from about 0.40 mm to about 0.60 mm; a tip length T of about 0.03 mm to about 0.20 mm, and in particular from about 0.05 mm to about 0.015 mm; and a height length H from about 0.30 mm to about 0.80 mm, and in particular from about 0.35 mm to about 0.60 mm.

FIG. 4U illustrates an energy director 137C having an isometric polygon shape with six sides where two sides identified as sides B and T may be substantially parallel relative to each other, two sides identified as sides H1A and H1B may be substantially parallel relative to each other, and the two opposite sides identified as sides H2A and H2B may have substantially the same length. In particular, the energy director 137B may be isometric along a center line C. The energy director 137B may have a base length B from about 0.20 mm to about 0.50 mm, and in particular from about 0.30 mm to about 0.40 mm; a tip length T of about 0.03 mm to about 0.20 mm, and in particular from about 0.05 mm to about 0.015 mm; a height length H1 from about 0.20 mm to about 0.40 mm, and in particular from about 0.25 mm to about 0.35 mm; and a height length H2 from about 0.20 mm to about 0.40 mm, and in particular from about 0.25 mm to about 0.35 mm, where the total height length H1+H2 may be from about 0.30 mm to about 0.80 mm, and in particular from about 0.35 mm to about 0.60 mm.

Figure 5B:
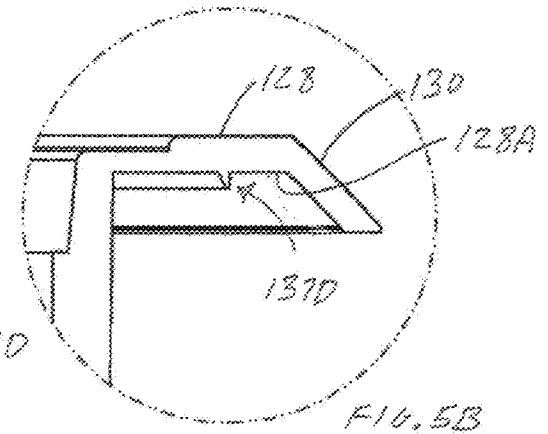
FIG. 5B shows an enlarge view of an encircled area 5B of FIG. 5A with the extension having an energy director protruding downwardly from the underside of the extension.
Figure 5D:
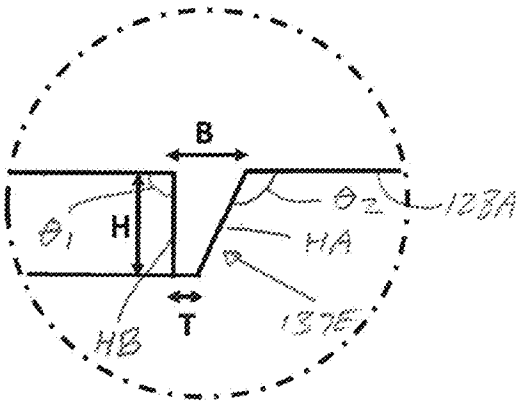
FIGS. 5D and 5E show alternative arrangement of the energy director illustrated in FIG. 5C.
Figure 5A:
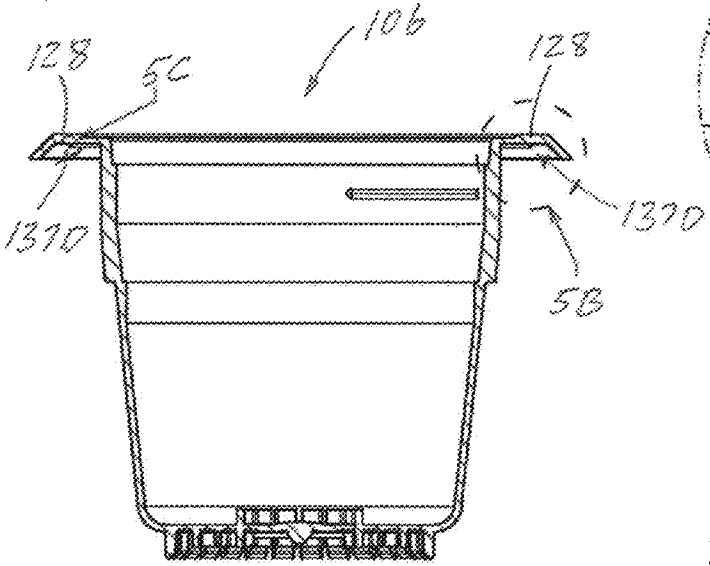
FIG. 5A shows a cross-sectional view of a filter.
Figure 5C:
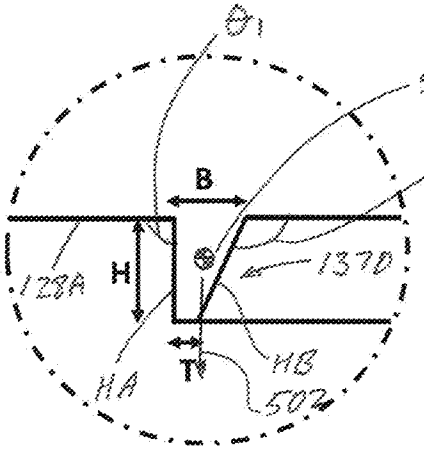
FIG. 5C shows an enlarge view of an encircled area 5C of FIG. 5A with an enlarge view of the energy director.

FIG. 5A shows a cross-sectional view of a filter 106 where the underside of the first section 128 may have alternative energy director 137D adapted to absorb the energy from an ultrasonic welding apparatus, such as from a linear and/or torsional ultrasonic welding apparatus, to melt and infuse with the rim 120 as discussed above. FIG. 5B shows an enlarge view of the circular area 5B in FIG. 5A; and FIG. 5C shows an enlarge view of the energy director 137D in the circular area 5C of FIG. 5A. The energy director 137B may have a trapezoidal shape with four sides where two sides identified as sides B and T may be substantially parallel relative to each other, and the two opposite sides identified as sides HA and HB may have different length such that the energy director 137D may be non-isometric. In particular, the side HA, which is on the distal side closer to the second section 130 than the side HB, may be substantially perpendicular relative to the underside 128A of the first section 128 where the angle θ1 may be from about 90° to about 100°, and in particular, about 91° to about 95°. The side HB may have an obtuse angle θ2 relative the underside 128A such that the side HB may be longer than the side HA, where the angle θ2 may be from about 105° to about 125°, and in particular, about 110° to about 120°.

The energy director 137D may have a base length B from about 0.20 mm to about 0.60 mm, and in particular from about 0.25 mm to about 0.45 mm; a tip length T of about 0.03 mm to about 0.20 mm, and in particular from about 0.05 mm to about 0.015 mm; and a height length H from about 0.30 mm to about 0.80 mm, and in particular from about 0.35 mm to about 0.60 mm. Note that due to the small dimensional size the energy directors discussed above, it is within the scope of the invention to have the sides be irregular, such as having the side T be round, semi-circular and/or irregular, and not be parallel with the side B. Also, the non-isometric shape of the energy director 137D may have a center of gravity 500 that is closer to the side HB such that the gravitational direction as represented by the direction arrow 502 may be offset from the midpoint of the side T; and as discussed in more detail below, such offset in the gravitational direction may assist in providing more consistent seal between the energy director 137D and the rim 120.

Figure 5E:
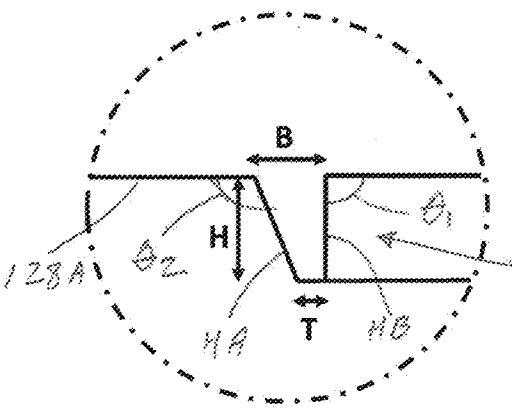

FIGS. 5E and 5D illustrate an alternative energy director 137E where the side HA, which is on the distal side closer to the second section 130 than the side HB, may form an obtuse angle θ2 relative the underside 128A such that the side HA may be longer than the side HB; and the side HB may form an angle θ1 relative to the underside 128A. Accordingly, the energy director 137 may have a variety of configurations to focus the energy from the ultrasonic welding system onto to the base layer. For example, the energy director 137 may have semi-circular, circular, trapezoidal, square, rectangular, irregular, pentagon, and the like configurations. In addition, the energy director 137 may be a separate element that may be placed between the extension 128 and the rim 120 for the purpose of releasably joining the extension 128 to the rim 120.

The shape and dimension of the energy director may depend on a number of factors, including, but not limited to: (1) force applied by the detaching member 210 on the underside 128A, as illustrated in FIG. 2B, to detach the first section 128 from the rim 120 of the container 104; (2) required sealing force on the energy director to hermetically seal the beverage ingredient within the assembled pod 100 to substantially maintain freshness of the beverage ingredient therein such as during the hot summer months which can increase pressure inside the pods; (3) required sealing force on the energy director to not unintentionally separate from the rim 120 during shipping and handling of the pods; (4) softness and/or hardness of the material used to mold the filter 106 with the energy director; (5) consistency of the ultrasonic energy applied to the energy director; and (6) consistency in which the energy director 137 may be formed on the underside 128A due to the small size of the energy director 137 where some of the dimensions may be less than 1.0 mm, such that the tolerances in the molding process may present some challenges to forming the energy director in a consistent manner. Accordingly, there may be a number of conflicting requirements for the energy director 137 since the sealing force cannot be too strong to prevent the detaching member 210 from detaching the first section 128 from the rim 120; on the other hand, the sealing force cannot be too weak where the first section 128 can unintentionally detach from the rim 120 during shipping and handling.

Another factor that may need to be considered is the inconsistencies in the tooling and molding process to form the small energy director 137. That is, conflicting requirements may present challenges to the design and making of the filter with the energy director 137. For instance, metal molds used to make the injected plastic parts may have a "parting line" where two metal parts come together, and during the injecting molding process, some of the heated fluid plastic material may flow into the parting line and form imperfections called "burr" or thin flanges. In most applications when the plastic parts are large relative to the energy director 137, the small imperfections like burrs may not impact the performance of the plastic parts. With small parts where satisfying the small dimensional requirements are important to meeting the performance criteria of the small parts, such imperfections like burr may hinder consistent performance of such small parts. Accordingly, there may be a number of factors that may need to be considered to meet the conflicting requirements of the energy director 137.

FIGS. 6A and 6B show a cross-sectional view of the filter 106 and the upper rim 120 of the container 104 to illustrate a manner in which the energy director 137D in reference to FIGS. 5A, 5B, and 5C may be utilized to provide a substantially consistent seal between the first section 128 and the rim 120. FIG. 6A shows a cross-sectional view of the filter 106 placed within the container 104 with the non-isometric energy director 137D placed over the rim 120 where the side HA may be closer to the second section 130 than the side HB before the pressure 600 from the upper horn (not shown) from the ultrasonic welding apparatus applies pressure on the first section 128 of the filter 106. Note, in this example, the energy director 137D may be ultrasonically welded to the rim 120 in an upright orientation. However, it is within the scope of the invention to orient the filter 106 and the container 104 in an downward orientation in a manner discussed above in reference to FIGS. 4I to 4L.

FIG. 6B illustrates that as the pressure 600 from the upper horn is applied to the first section 128, without being bound by any theory, the first section 128 of the filter 106 may act as a wide circular table with the energy director 137D acting as legs. Again, without being bound by any theory, the non-isometric shape of the energy director 137D, in a manner discussed above in reference to FIGS. 5B and 5C, may shift its center of gravity towards the side HB such that the pressure 600 may cause the side T of the energy director 137D to shift towards the second section 130 as indicated by the direction arrow 602. As the side T shifts towards the second section 130 from its initial position as illustrated in FIG. 6A, in reference to the vertical reference line 604, the lateral movement of the side T may cause friction between the side T and the rim 120 to further enhance the seal between the side T and the rim 120. For example, if ultrasonic welding method, such as a linear or vertical ultrasonic welding, is used to seal the energy director 137D to the rim 120, the non-isometric energy director 137D may provide a more consistent seal due to the energy applied vertically and laterally to seal the side T to the rim 120. In this regard, in reference to FIG. 5C, an energy director that has a non-isometric shape may be generally described as having a center of gravity that is offset such that the gravitational direction may be offset from the midpoint of the tip side that engages with a second layer to be ultrasonically welded.

Again, without being bound by any theory, another factor that may allow the energy director 137D to provide a more consistent seal may be that the non-isometric shape of the energy director 137D. With the side HA being substantially vertical, this means that less material may be provided at the side T, by way of analogy—such as a pencil with a finer tip, such that as the side T melts due to the ultrasonic energy, the amount of material that is melted at the side T may be more precisely controlled to provide a more consistent seal between the energy director 137D and the rim 120.

Figure 7A:
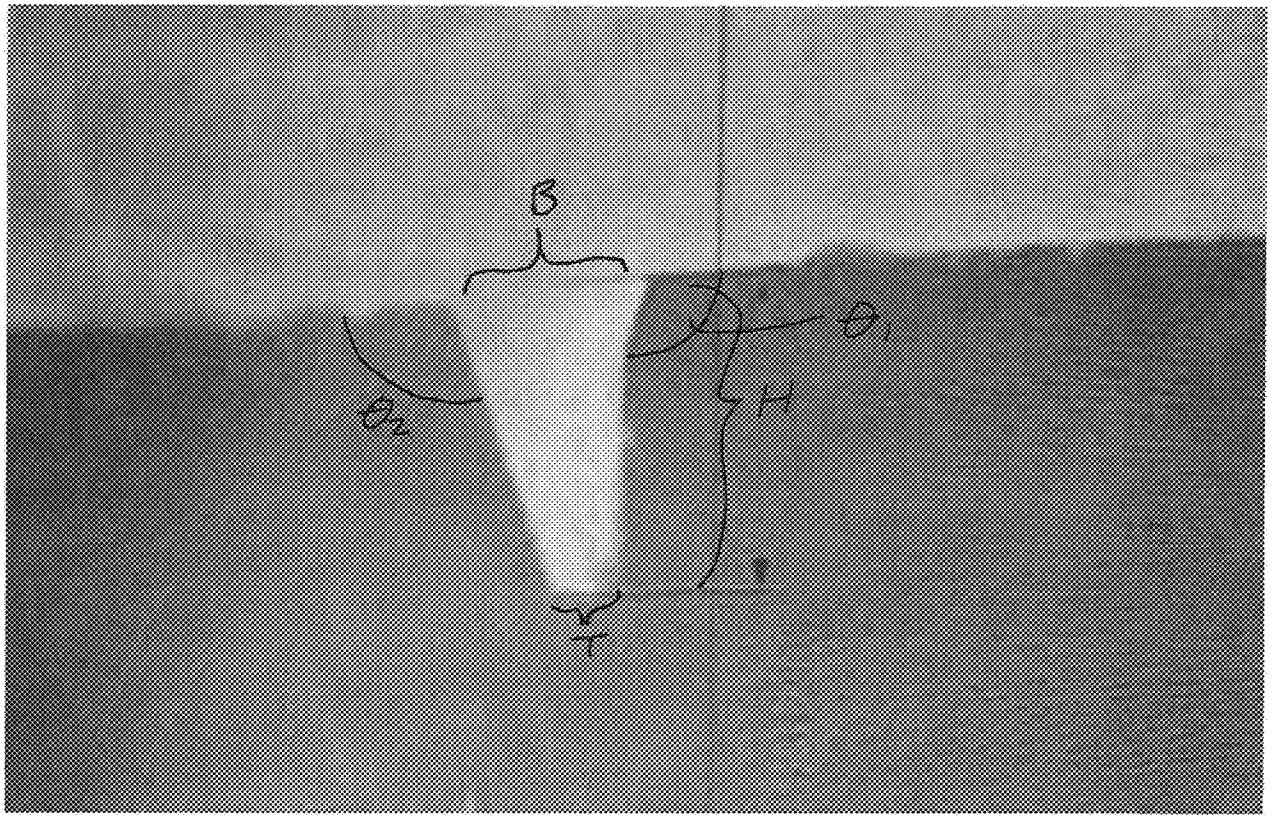
FIG. 7A shows a cross-sectional view of a sample energy director made as illustrated in FIG. 5C for testing.

FIG. 7A shows a cross-section view a sample energy director 137D that was injection molded using polypropylene to test the consistency of the seal between the energy director 137D and around the circumference of the rim 120. The outer container 104 was from Printpack Inc.® model no. P150 which was formed with an inner skim layer. The design parameters of the energy director were: (1) B was approximately (≅) 0.32 mm; (2) H≅0.44 mm; (3) T≅0.10 mm; (4) θ1≅92°; and (5) θ2≅115°.

Figure 7B:
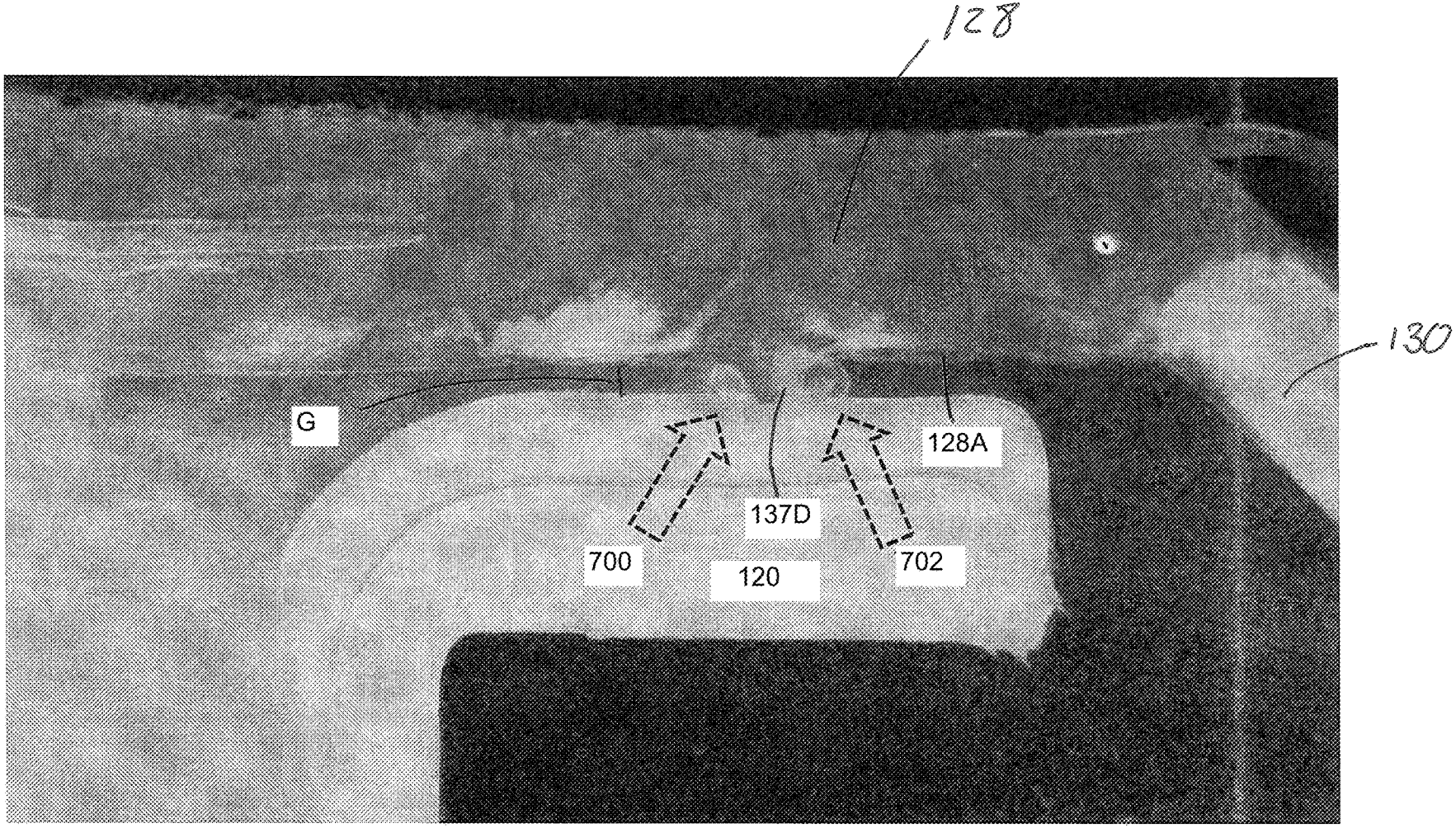
FIGS. 7B through 7F show cross-sectional views of sample filters sealed to the containers by melting the energy director therebetween to illustrate the consistency of the weld.
Figure 7C:
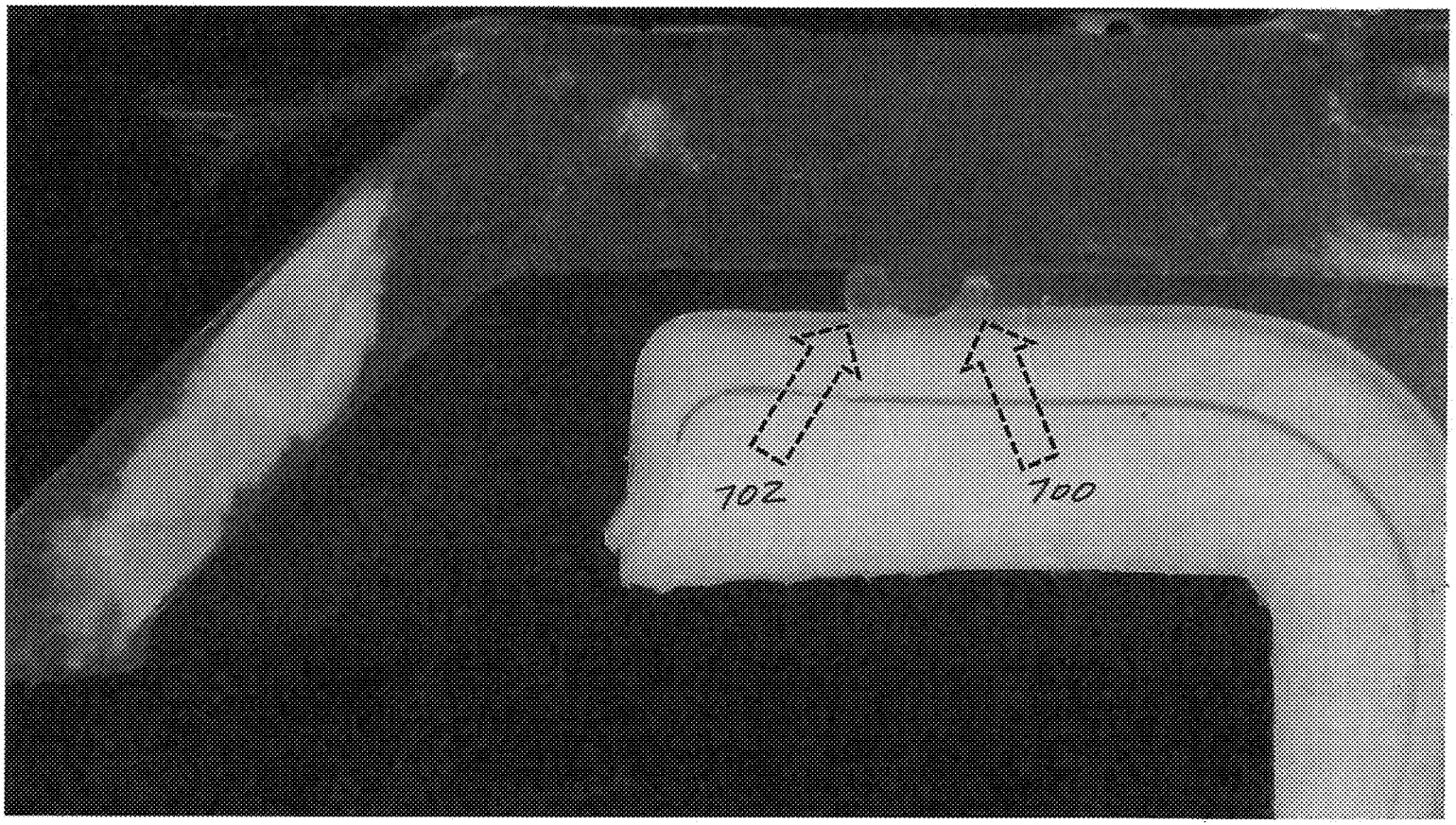
Figure 7D:
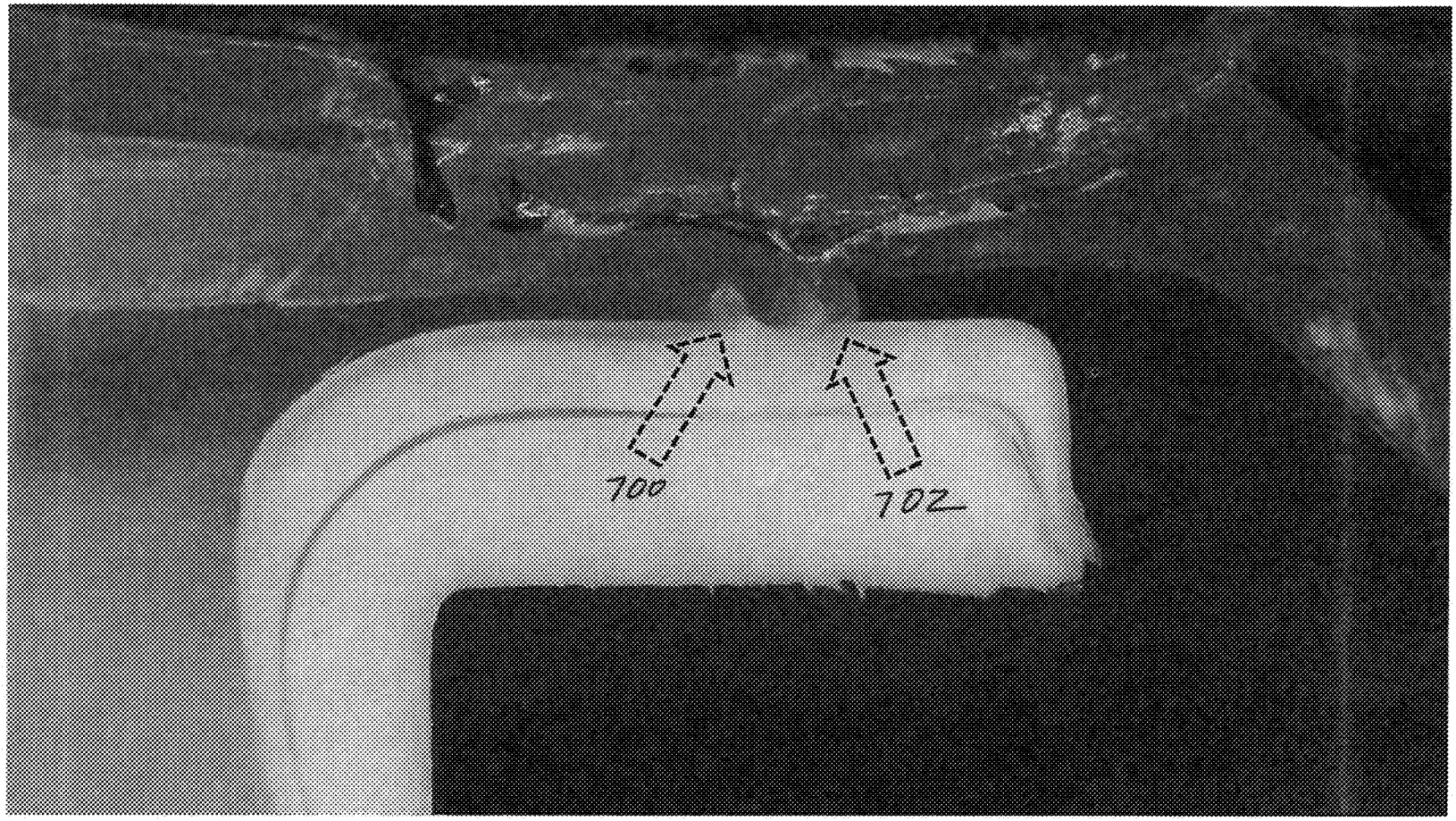
Figure 7E:
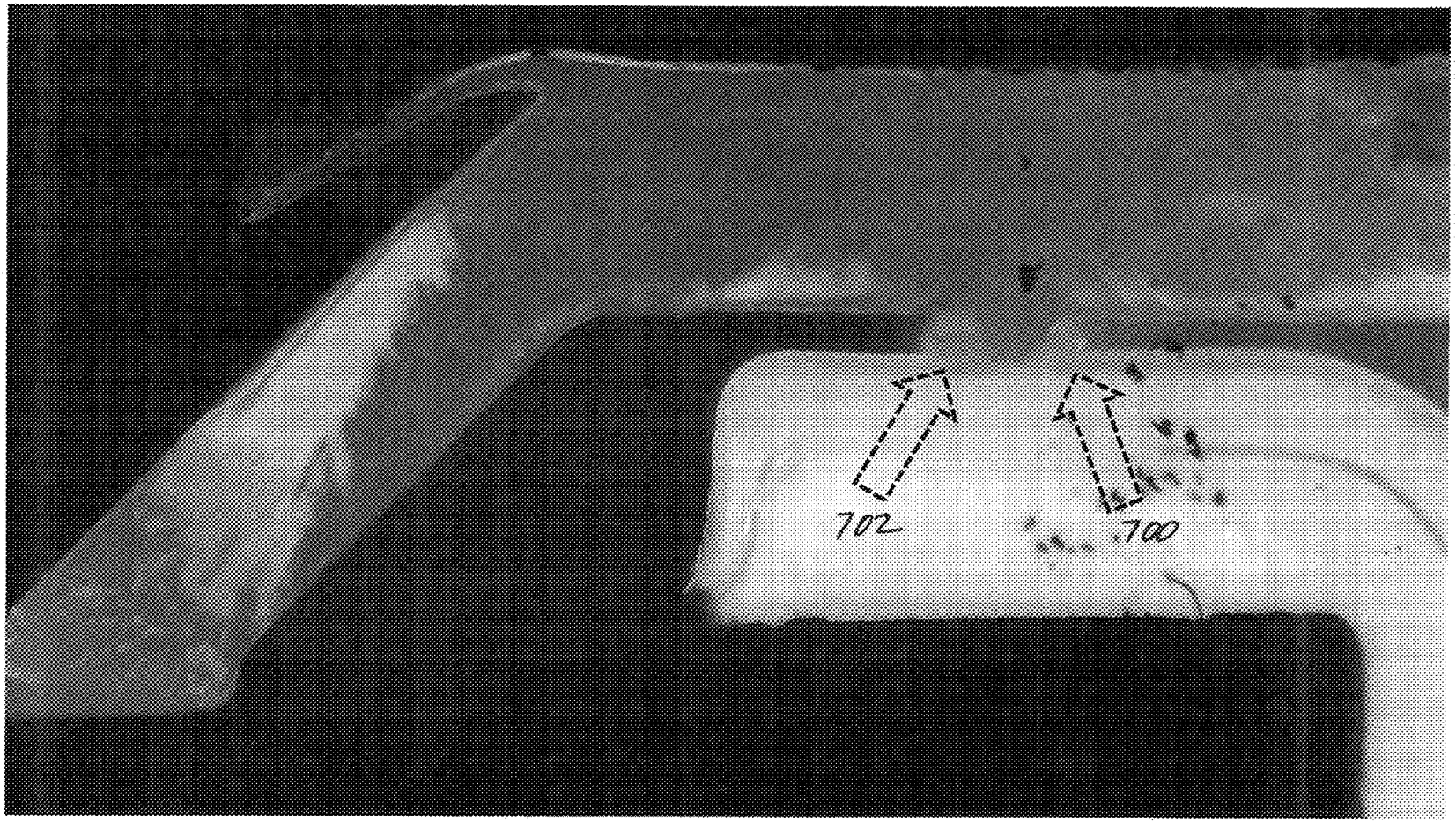

FIG. 7B shows a cutout view of the energy director 137D sealed to the rim 120. In this test, a linear ultrasonic welding apparatus from Telsonic Ultrasonic® system USV 750 F 20 P1.2 system with MAG 20 Khz 1.2 kw generator was used. Note that the design parameters and the ultrasonic energy applied to the energy director to seal the energy director to a second layer may vary depending a variety of factors such as the materials, flexibility, and the requirements of the seal between the two layers. For this particular application, after some customary adjustments, it was found that the energy director 137D provided sufficient seal with the rim 120 to pass the drop test and the water test—where pods are sealed with coffee inside and boxed, and the boxes are dropped several times to simulate shipping and handling situations; and the same pods are submerged under water and squeezed to test to see if air bubbles escape from the seal.

After several rounds of testing, it was found that the sealed energy director 137D met the drop test and water testing requirements. Thereafter, the same pods were inserted into a testing brewer, where the detachment member 210 in reference to FIG. 2B applies from about 20N to 40N of force upon the underside 128A of the first section 128; and after several rounds of testing the pods, it was found that the sealed energy director 137D separated from the rim 120 to meet the opening testing requirements. In this particular application, it was found that setting the Telsonic ultrasonic apparatus to the following parameters resulted a seal that satisfied our requirements: (1) an energy level from 15 Ws to 35 Ws, and in particular from about 25 Ws to about 30 Ws; (2) the horn vertical travel distance of about 0.25 mm to about 0.45 mm, and in particular about 0.30 mm to about 0.40 mm; and (3) the applied pressure P1 of about 0.2 to 0.4 bar; and pressure P2 of about 0.4 to 0.9 bar of pressure, and in particular about 0.6 to 0.8 bar of pressure. Note that there are other parameters which can impact the overall performance of the energy director 137D which are not discussed here as these parameters may change and can be adjusted according to its unique applications. And the parameters discussed here are provided as illustrative one example only, and should not be taken as limitation with regard to the scope of invention.

FIG. 7B also illustrates the manner in which seal between the first section 128 and the rim 120 may be formed. As the energy director 137D absorbs the ultrasonic energy, the tip side T of the energy director 137D melts to form an inner bead 700 and an outer bead 702 with the remaining portion of the energy director 137D therebetween. Based on the cutout view shown in FIG. 7B, the outer bead 702, which is closer to the second section 130, appears to be bigger than the inner bead 700. Again, without being bound by any theory, this may be due to the side T sliding laterally towards the second section 130, as discussed above in reference to FIG. 6B, and as it does, the distal end side T may push the melted energy director towards the second section 130 thereby forming a round shape much like rolling a snow ball which gets larger with every roll. As such, the vertical ultrasonic energy may be, in part, redirected towards the lateral movement to provide a more consistent ultrasonic weld between the energy director 137D and the rim 120. In addition, the time and amount of energy applied to the energy director 137D may be controlled to form a gap G between the underside 128A and the rim 120. In this application the gap distance G was about 0.10 mm. Again, without being bound by any theory, one of the reasons the energy director 137D may have done well in the drop test and the water test is that with the energy director 137D sandwiched between two beads 700 and 702, the combination may act like a Ziplock® bag which keeps the contents inside the bag fresh by keeping outside air from entering the bag while keeping the contents inside.

Figure 7F:
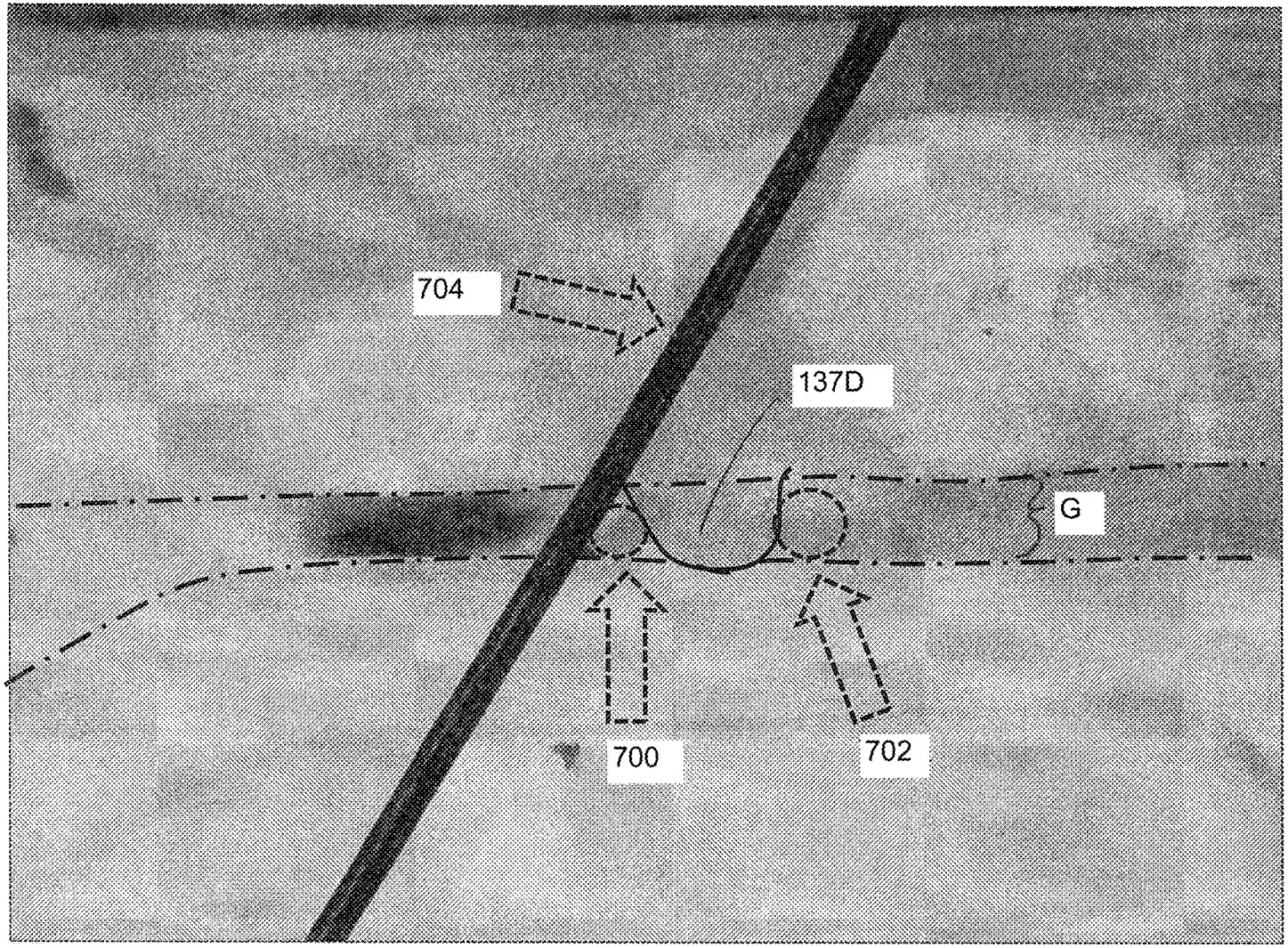

FIGS. 7C through 7F are provided to illustrate that at least with the cutout views of the sample sealed pods tested, the outer beads 702 appear to be bigger in size relative to their counterpart inner beads 700. In particular, FIG. 7F is provided with a strand of hair 704 juxtaposed to the energy director 137D between the inner and outer beads 700 and 702 to provide some context with regard to the small size of the elements discussed above.

Figure 7G:
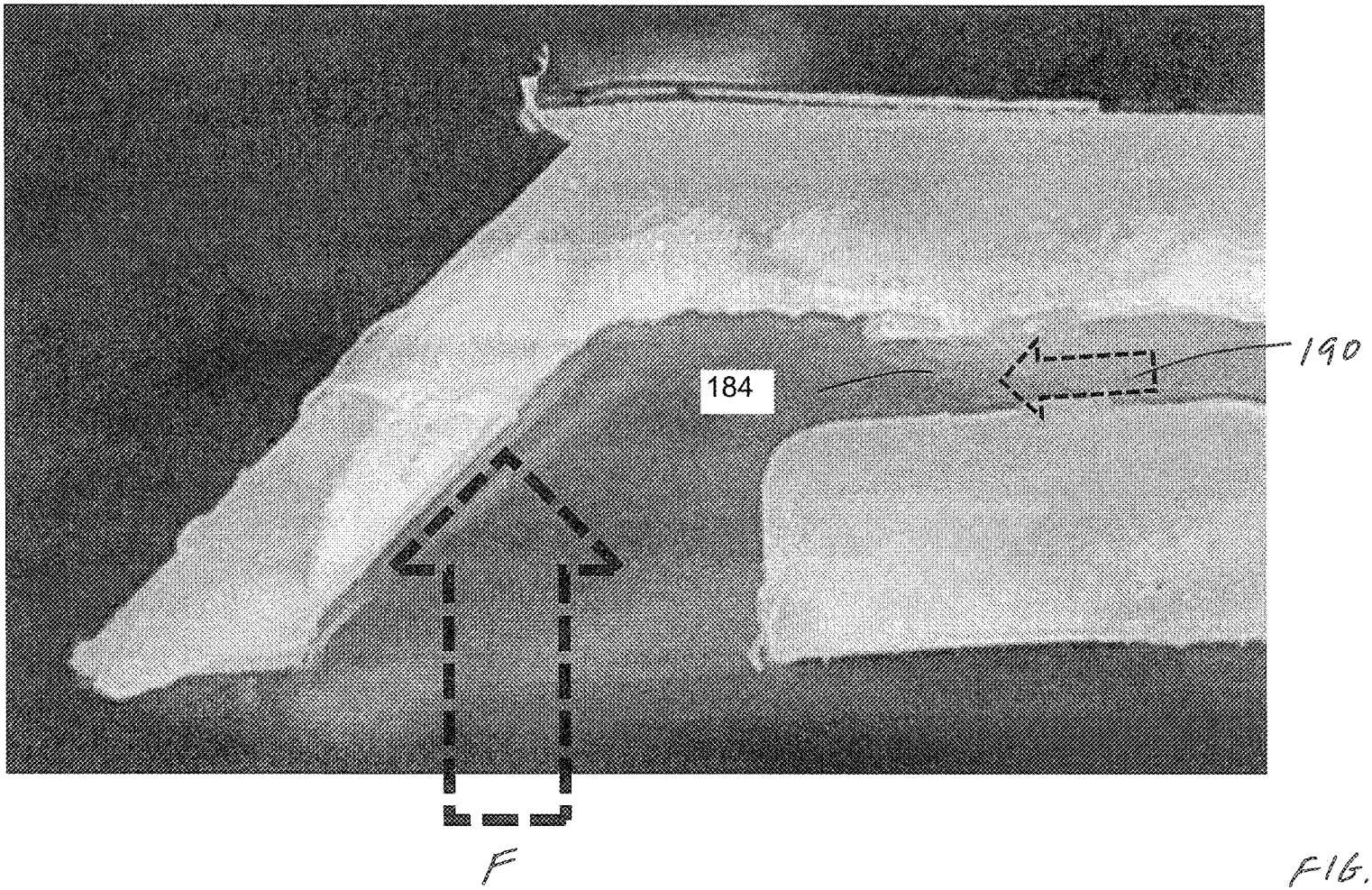
FIGS. 7G and 7H show cross-sectional views of sample filters separated from their respective containers.
Figure 7H:
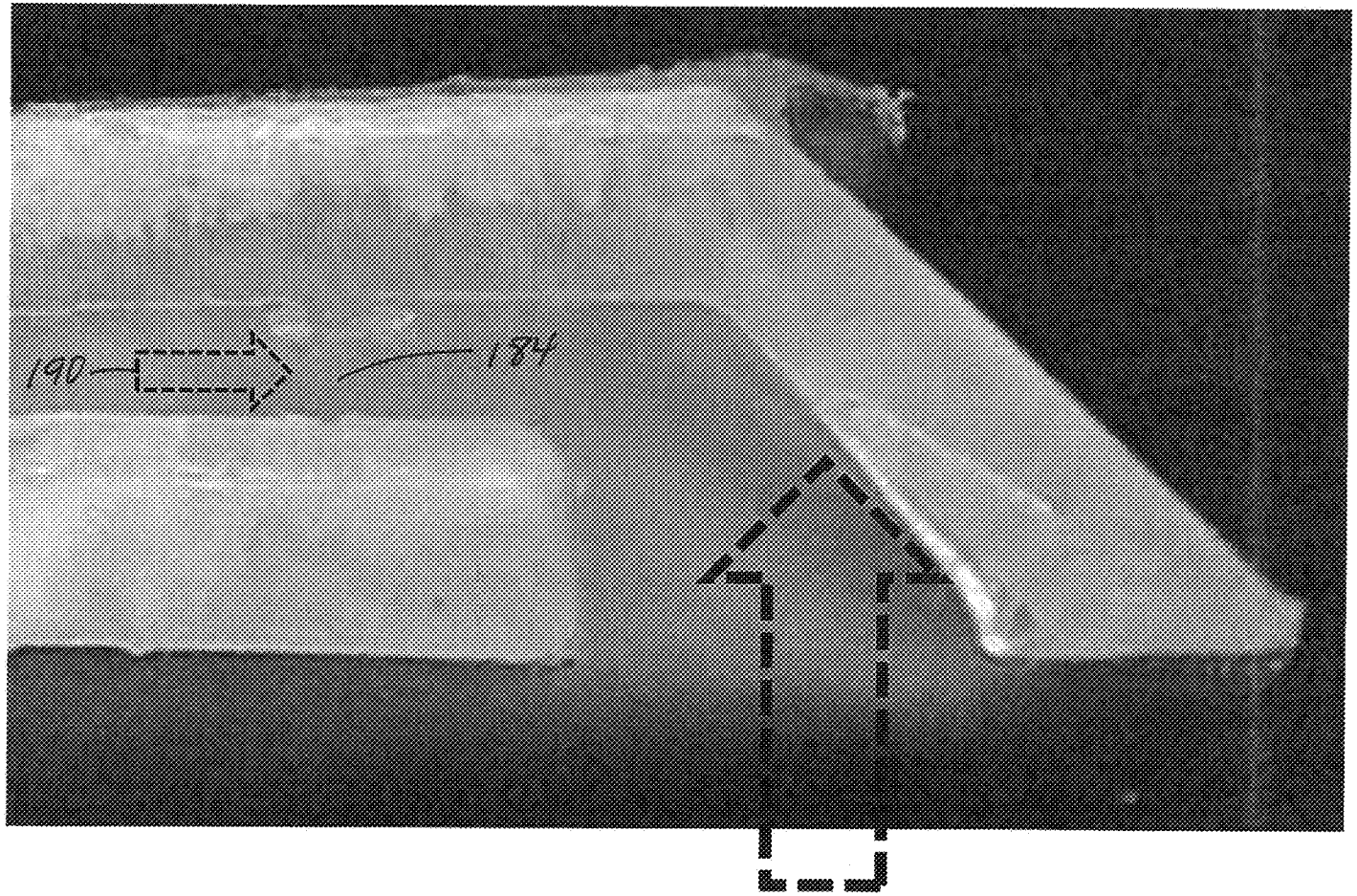

FIGS. 7G and 7H illustrate the energy director 137D and the inner and outer beads 700 and 702 separating from the rim 120 upon an application of force F upon the underside 128A to form the gap 184 to allow the beverage 190 to flow out of the pod in a manner discussed above in reference to FIGS. 2A through 2D.

Figure 8A:
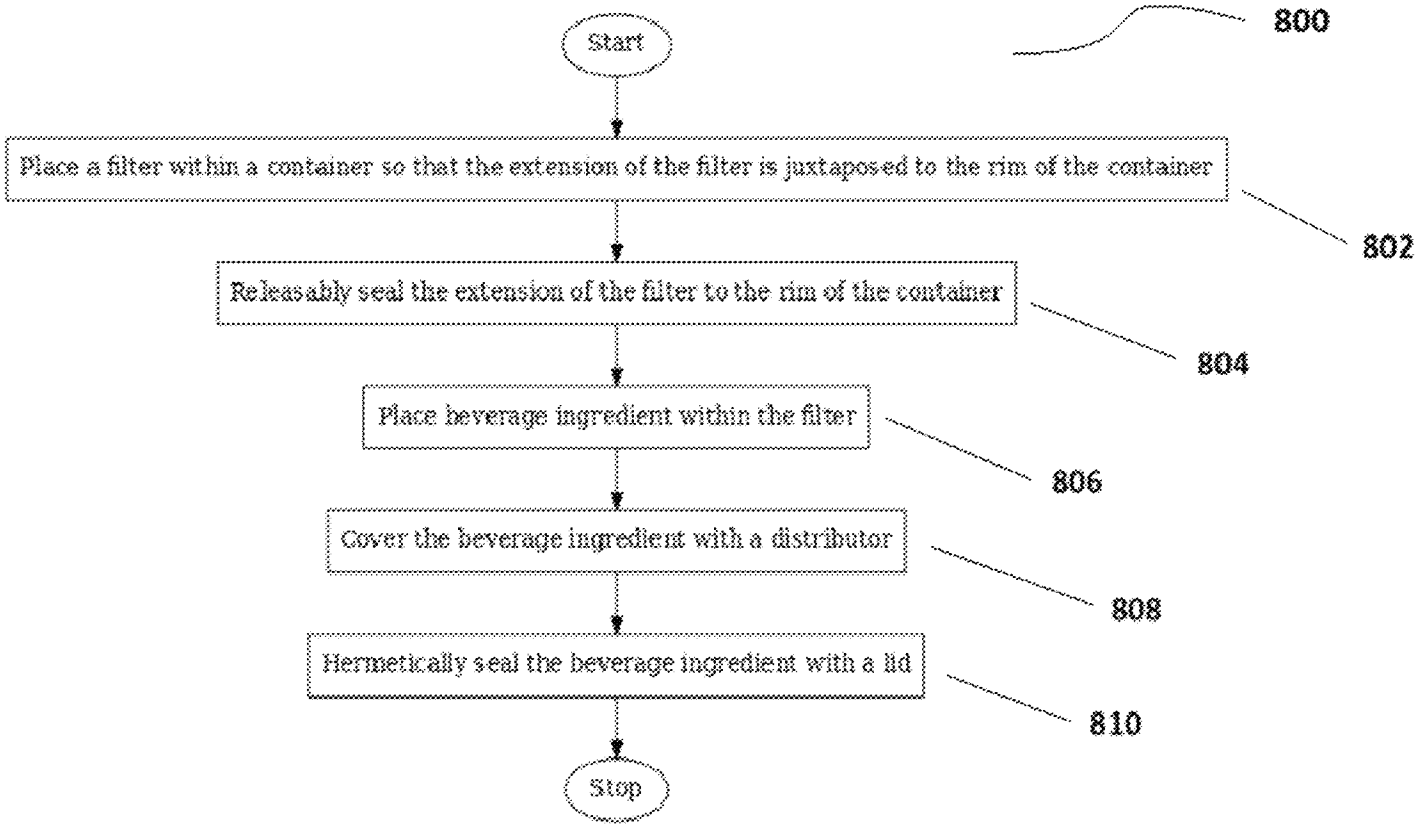
FIG. 8A shows a flow chart for releasably sealing a beverage pod.

FIG. 8A illustrates a flow chart 800 which may include one or more of the following steps to assemble the pod 100 as discussed above in reference to FIGS. 1A and 1B. In step 802, the filter 106 may be placed within the container 104 such that the extension 126 may be juxtaposed to the rim 120 of the container. This may be done with the container 104 and the filer 106 in an upright or inverted position. In step 804, the extension 126 and the rim 120 may be releasably sealed together. This may be done in a variety of methods known to one skilled in the art such as via adhesive liner, glue, heat, vertical ultrasonic welding, torsional ultrasonic welding, and etc. In step 806, the beverage ingredient 110 such as coffee ground, espresso ground, and tea leaf may be poured into the filter 106 through a variety of method known to one skilled in the art. In step 808, the distributor 112 may be optionally placed into the filter 106 to substantially enclose the opening 154 so that the distributor 112 may be juxtaposed to the beverage ingredient 110. Note that the distributor 112 may or may not be part of the assembled pod 100; and a variety of methods known to one skilled in the art may be optionally utilized to shower beverage ingredient 110 to more evenly wash and extract the beverage from the beverage ingredient 110. And in step 810, the lid 114 may be sealed to the extension 126 such as on the first section 128 and/or the second section 130. This may be done in a variety of methods known to one skilled in the art such that the seal may hermetically seal the lid 114 onto the filter 106 via adhesive liner, glue, heat, ultrasonic welding, torsional ultrasonic welding, and etc.

Figure 8B:
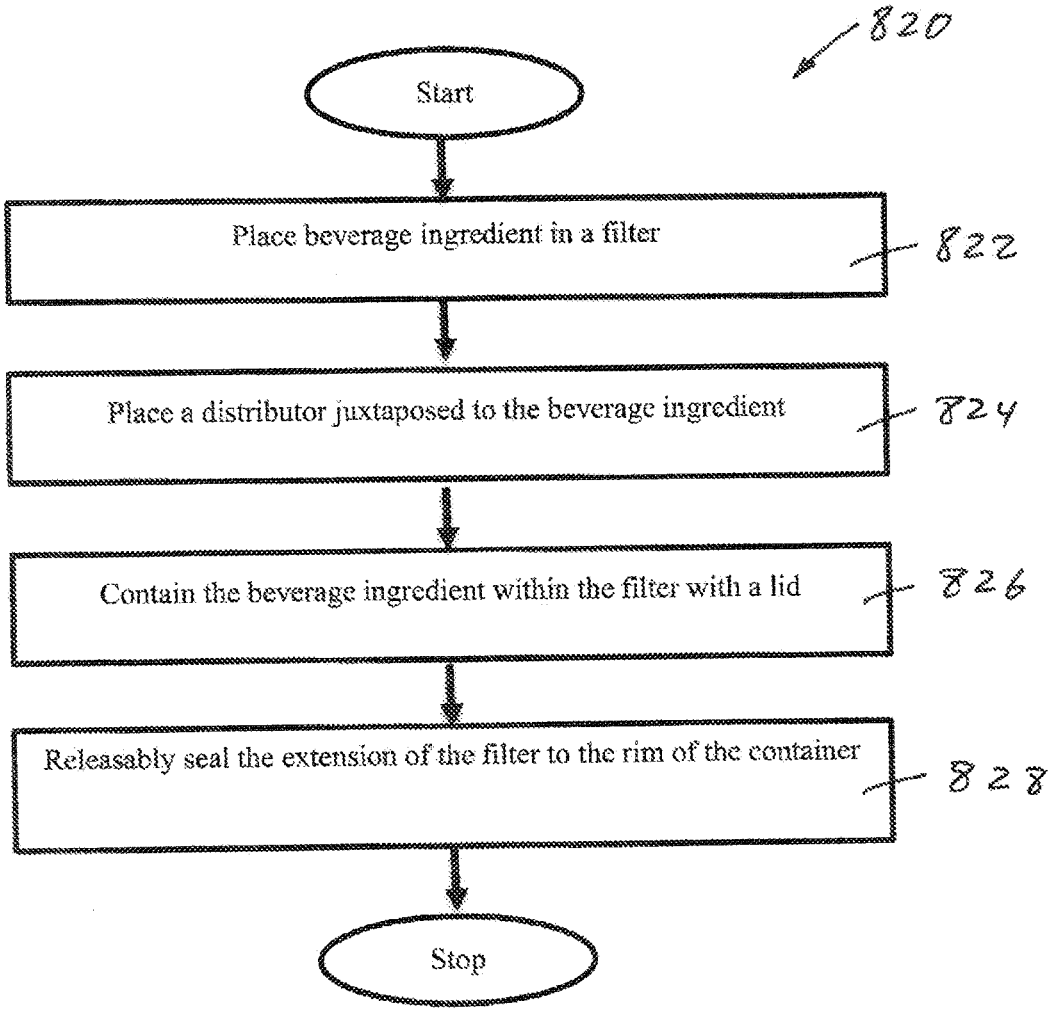
FIG. 8B shows another flow chart for releasably sealing a beverage pod.

FIG. 8B illustrates a flow chart 820 which may include one or more of the following steps to assemble the pod 100 as discussed above in reference to FIGS. 3A through 3D. In step 822, the beverage ingredient 110 such as coffee ground, espresso ground, and tea leaf may be poured into the filter 106. The filter 106 may have an energy director 137 and/or a cavity 324 underneath the first section 128 as discussed above in reference to FIG. 4M through 4R. In step 824, the distributor 112 may be optionally placed juxtaposed to the beverage ingredient 110. In step 826, the beverage ingredient 110 may be contained within the filter 106 by placing a lid 114 over the beverage ingredient 110. The lid 114 may be sealed to the extension 126 such as on the first section 128 and/or the second section 130. The lid 114 may be sealed to the extension 126 without altering and/or damaging the energy director 137. In step 828, the extension 126 and the rim 120 of the container 104 may be releasably sealed together. This may be done in a variety of methods known to one skilled in the art such as via adhesive liner, glue, heat, ultrasonic welding, torsional ultrasonic welding, and etc. With the ultrasonic methods such as with vertical ultrasonic and/or torsional ultrasonic welding, the rim 120 of the container may have an energy director 137 and/or a cavity 324, as discussed above in reference to FIG. 4M through 4R, to align the energy director 137 to the corresponding cavity 324.

Figure 8C:
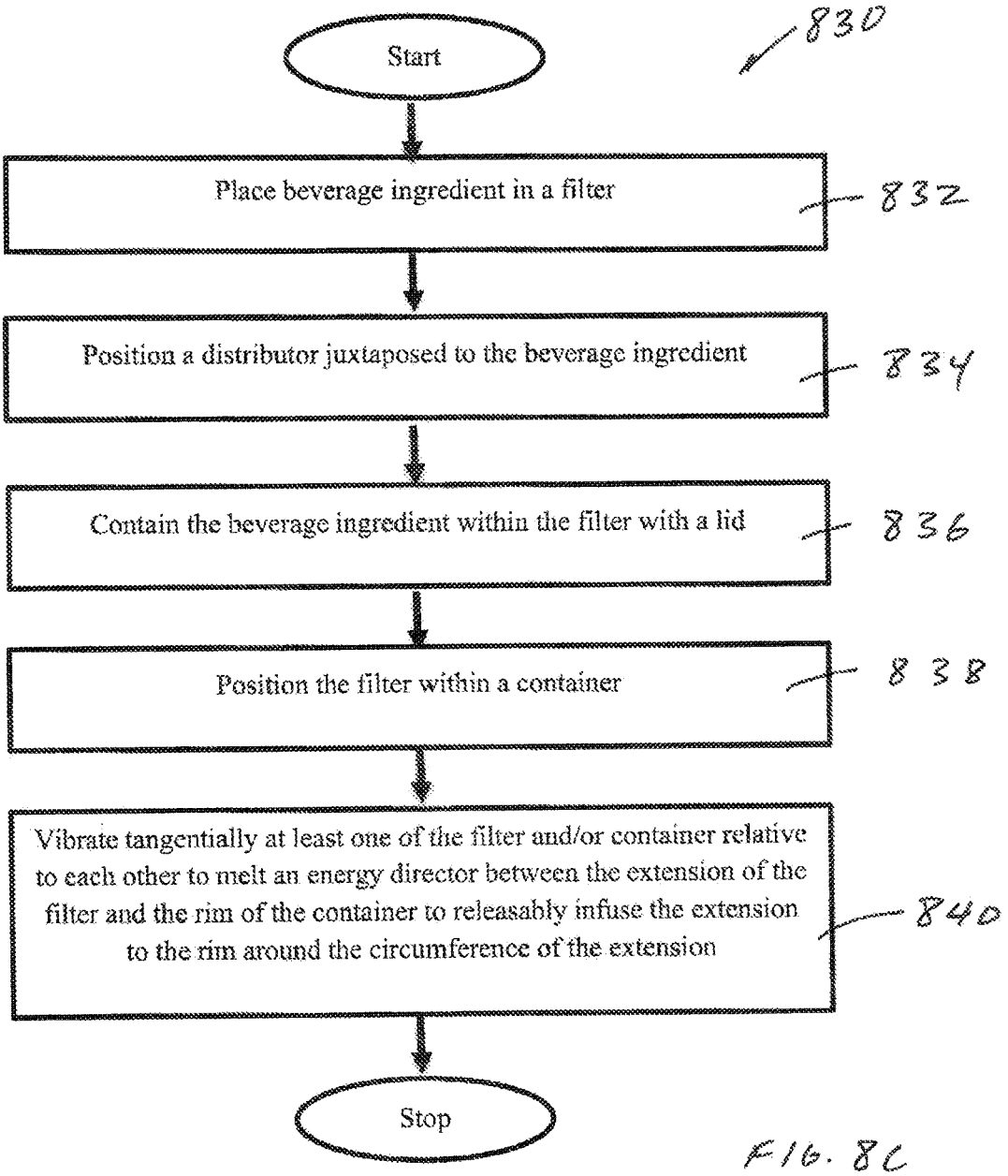
FIG. 8C shows an alternative flow chart for releasably sealing a beverage pod.

FIG. 8C illustrates a flow chart 830 which may include one or more of the following steps to assemble the pod 100 as discussed above in reference to FIGS. 3A through 3D. In step 832, the beverage ingredient 110 may be placed into the filter 106. The filter 106 may have an energy director 137 and/or a cavity 324 underneath the first section 128 as discussed above in reference to FIG. 4M through 4R. In step 834, the distributor 112 may be optionally placed juxtaposed to the beverage ingredient 110. In step 836, the beverage ingredient 110 may be contained within the filter 106 by placing a lid 114 over the beverage ingredient 110. The lid 114 may be sealed to the extension 126 such as on the first section 128 and/or the second section 130. The lid 114 may be sealed to the extension 126 without altering and/or damaging the energy director 137. In step 838, the filter 106 may be positioned within the container 104 by either inserting the filter 106 into the container 104 or by placing the container over the filter 106. In step 840, the torsional ultrasonic welding method may be utilized to releasably seal the extension 126 to the rim 120. This may be accomplished by vibrating tangentially at least one of the filter 106 and/or container 104 relative to each other to melt an energy director 137 between the extension 128 and the rim 120 to releasably infuse the extension 128 to the rim 120 without damaging extension 128 and the rim 120 around the circumference of the extension. Note that the rim 120 of the container may have an energy director 137 and/or a cavity 324, as discussed above in reference to FIG. 4M through 4R, to align the energy director 137 to the corresponding cavity 324.

Figure 8D:
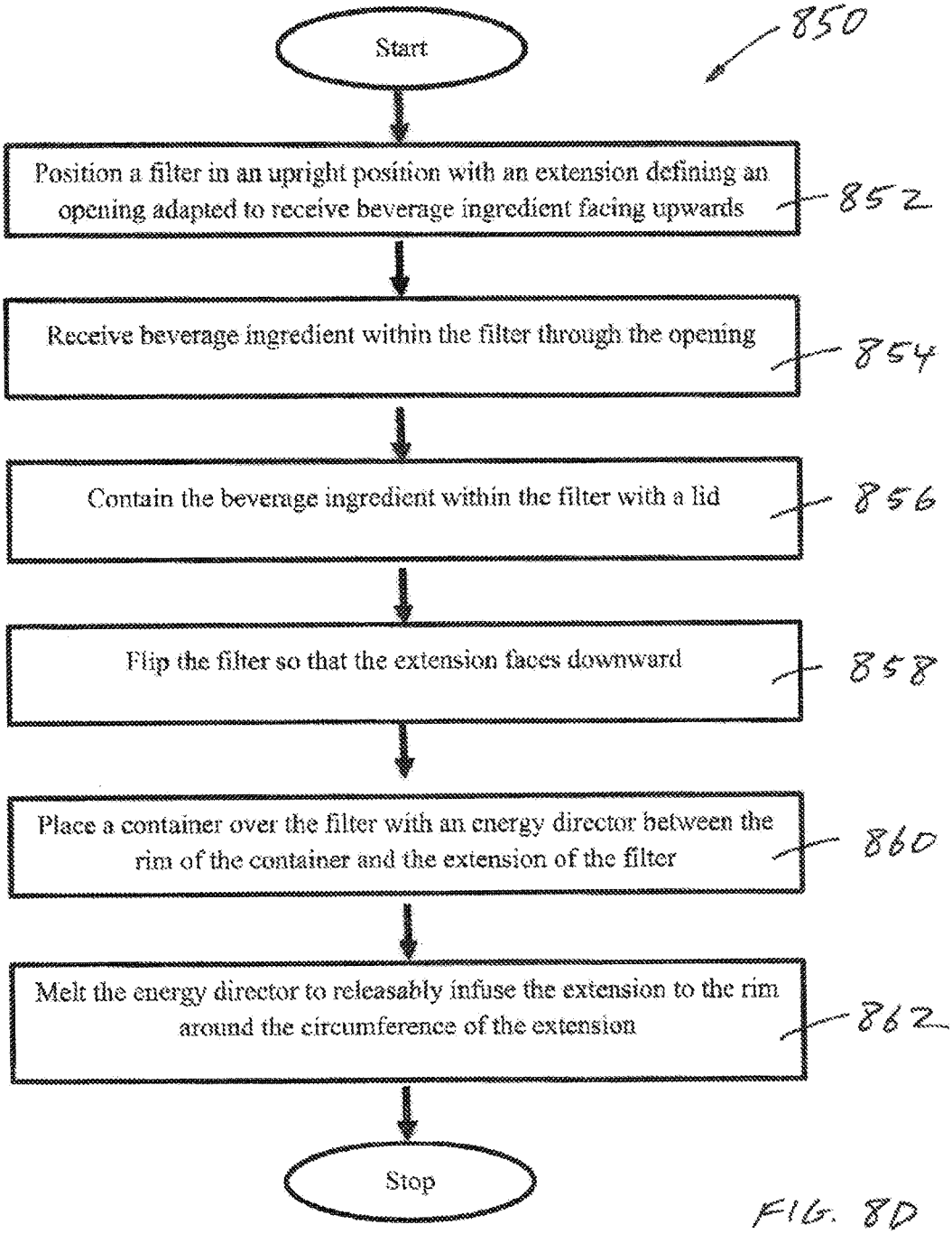
FIG. 8D shows still another flow chart for releasably sealing a beverage pod.

FIG. 8D illustrates a flow chart 850 which may include one or more of the following steps to assemble the pod 100 as discussed above in reference to FIGS. 4A through 4L. In step 852, the filter 106 may be positioned in an upright position with the extension 128 defining an opening 154 adapted to receive the beverage ingredient 110. In step 854, the beverage ingredient 110 may be placed into the filter 106. The filter 106 may have an energy director 137 and/or a cavity 324 underneath the first section 128 as discussed above in reference to FIG. 4M through 4R. In step 856, the distributor 112 may be optionally placed juxtaposed to the beverage ingredient 110 to substantially contain beverage ingredient 110 within the filter 106. The lid 114 may be sealed to the extension 126 such as on the first section 128 and/or the second section 130. The lid 114 may be sealed to the extension 126 without altering and/or damaging the energy director 137. In step 858, the assembled filter 108 may be inverted or flipped so that the extension faces downward. In step 860, the filter 106 may be positioned within the container 104 by either inserting the filter 106 into the container 104 or by placing the container over the filter 106 such that the energy director 137 may be between the rim 120 and the extension 128. Note that it is within the scope of the invention to provide the energy director 137 as a separate element such as a ring placed onto the rim 120 or the first section 120 where the ring may be located between the rim 120 and the first section 128 prior to the torsional ultrasonic welding step. In step 862, the energy director 127 may be melted to releasably infuse the extension 128 onto the rim 120. This may be accomplished by vibrating tangentially at least one of the filter 106 and/or container 104 relative to each other to melt an energy director 137 between the extension 128 and the rim 120 to releasably infuse the extension 128 to the rim 120 without damaging extension 128 and the rim 120 around the circumference of the extension. For example, the energy director 127 may be melted via the torsional ultrasonic welding method to releasably seal the extension 126 to the rim 120. Note that the rim 120 of the container may have an energy director 137 and/or a cavity 324, as discussed above in reference to FIG. 4M through 4R, to align the energy director 137 to the corresponding cavity 324.

While various embodiments of the invention have been described, it will be apparent to those ordinarily skilled in the art that many more embodiments and implementations are possible within the scope of this invention. Moreover, various features and functionalities described in this application and Figures may be combined individually and/or a plurality of features and functionalities with others. For instance, the energy directors discussed in this application may be utilized in other applications other than with pods such as sealing a lid onto a container where hermitically sealing the items therein may be an important criterion and being able to open the lid quickly is another important consideration such as in metal devices. Accordingly, the invention is not to be restricted except in light of the attached claims and their equivalents.

What is claimed is:

1. A method of assembling a beverage pod having a filter having an extension, and a container having a rim, the method comprising:

positioning the extension of the filter juxtaposed to the rim of the container; and applying a predetermined amount of vertical ultrasonic energy on a non-isometric shape energy director between the extension and the rim where a center of gravity of the energy director is offset relative to a midpoint of a distal tip side such that the vertical ultrasonic energy causes the distal tip side to slide outwardly, and the predetermined amount of vertical ultrasonic energy releasably joins the energy director to the rim around a circumference of the extension, where the extension has an outer portion that extends outwardly farther than the rim, and an application of force upon the outer portion of the extension causes the extension to separate from the rim.

2. The method according to claim 1, where the extension has an underside with an energy director protruding downwardly therefrom to be placed over the rim of the container, the energy director having a non-isometric shape with an inner side and an outer side converging towards a tip side where the inner side is tapered relative to the underside to form an obtuse angle therebetween, and the outer side is substantially perpendicular relative to the underside.

3. The method according to claim 2, where the obtuse angle is from 105° to 125°.

4. The method according to claim 2, where the outer side forms an angle with the underside of from 91° to 95°.

5. The method according to claim 2, where the energy director forms a base along the underside having a width from 0.25 mm to 0.45 mm.

6. The method according to claim 2, where the tip side has a width from 0.05 mm to 0.015 mm.

7. The method according to claim 2, where the outer side has a height relative to the underside from 0.35 mm to 0.60 mm.

8. The method according to claim 2, where the obtuse angle is from 105° to 125°, the tip side has a width from 0.05 mm to 0.015 mm, and the outer side has a height length relative to the underside from 0.35 mm to 0.60 mm.

9. The method according to claim 1, where at least one of the extensions or the rim has the energy director.

10. The method according to claim 1, where the rim has the energy director protruding from a topside of the rim.

11. The method according to claim 1, where the step of applying includes hermetically joining the energy director to the rim to substantially prevent air from passing between the extension and the rim.

* * * * *